US009443398B2

(12) United States Patent
Pawloski et al.

(10) Patent No.: US 9,443,398 B2
(45) Date of Patent: Sep. 13, 2016

(54) ELECTRONIC GAMING DEVICE WITH REEL-OF-ONE FUNCTIONALITY

(71) Applicant: Cadillac Jack, Inc., Duluth, GA (US)

(72) Inventors: Jason Prometheus Pawloski, Decatur, GA (US); Eric Steven Boese, Decatur, GA (US); Keith James Menchin, Atlanta, GA (US)

(73) Assignee: Cadillac Jack, Inc., Duluth, GA (US)

( * ) Notice: Subject to any disclaimer, the term of this patent is extended or adjusted under 35 U.S.C. 154(b) by 137 days.

(21) Appl. No.: 14/027,002

(22) Filed: Sep. 13, 2013

(65) Prior Publication Data

US 2015/0080085 A1 Mar. 19, 2015

(51) Int. Cl.
*G07F 17/32* (2006.01)
*G07F 17/34* (2006.01)

(52) U.S. Cl.
CPC ..... *G07F 17/34* (2013.01)

(58) Field of Classification Search
None
See application file for complete search history.

(56) References Cited

U.S. PATENT DOCUMENTS

| | | | | |
|---|---|---|---|---|
| 8,092,298 | B2 * | 1/2012 | Gauselmann | 463/20 |
| 8,512,127 | B2 * | 8/2013 | Jaffe et al. | 463/21 |
| 2004/0023714 | A1 * | 2/2004 | Asdale | 463/22 |
| 2009/0298574 | A1 * | 12/2009 | Gauselmann | 463/20 |
| 2011/0201406 | A1 * | 8/2011 | Jaffe et al. | 463/21 |
| 2012/0034967 | A1 * | 2/2012 | Owen et al. | 463/20 |

* cited by examiner

*Primary Examiner* — Omkar Deodhar
(74) *Attorney, Agent, or Firm* — Weide & Miller, Ltd.

(57) ABSTRACT

Examples disclosed herein relate to systems and methods for utilizing one or more reel-of-one symbol functionalities. The electronic gaming device may include a memory, a processor, and a plurality of reels. The plurality of reels may include one or more areas. The memory may include one or more reel-of-one functionality modules. The processor may generate one or more symbols to be located in the one or more areas and to generate one or more reel-of-one symbol groupings to be placed on one or more reels.

18 Claims, 28 Drawing Sheets

ELECTRONIC GAMING DEVICE WITH REEL-OF-ONE FUNCTIONALITY

FIELD

The subject matter disclosed herein relates to an electronic gaming systems and methods for providing reel-of-one functionality game play. More specifically, the disclosure relates to systems, devices, and methods, which provide reel-of-one functionality game play to one or more players.

INFORMATION

The gaming industry has numerous casinos located both worldwide and in the United States. A client of a casino or other gaming entity can gamble via various games of chance. For example, craps, roulette, baccarat, blackjack, and electronic or electromechanical games (e.g., a slot machine, a video poker machine, and the like) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more reel-of-one game play functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
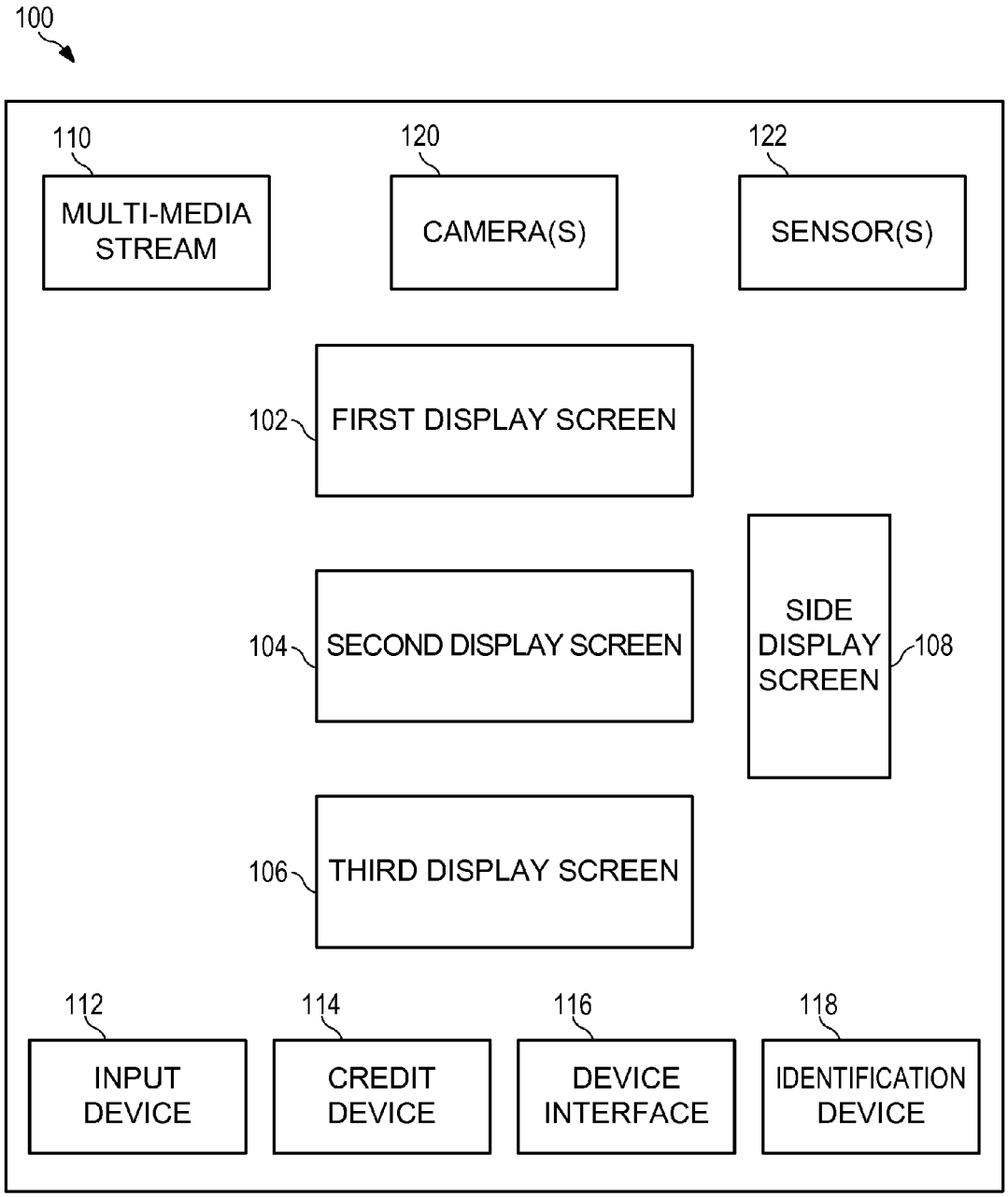
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, an identification device 118, one or more cameras 120, and/or one or more sensors 122. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to select one or more reel-of-one functionalities, to obtain player's point balances, to obtain any player point data, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. In another example, the language, sound level, music, placement of multi-media streams, one or more game functionalities (e.g., one or more reel-of-one functionalities, game type 1, game type 2, game type 3, etc.) may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include reel-of-one gaming options only. Therefore, only games which include reel-of-one gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display that the electronic gaming machine supports universal player cards, to display one or more warnings relating to game security, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Figure 2:
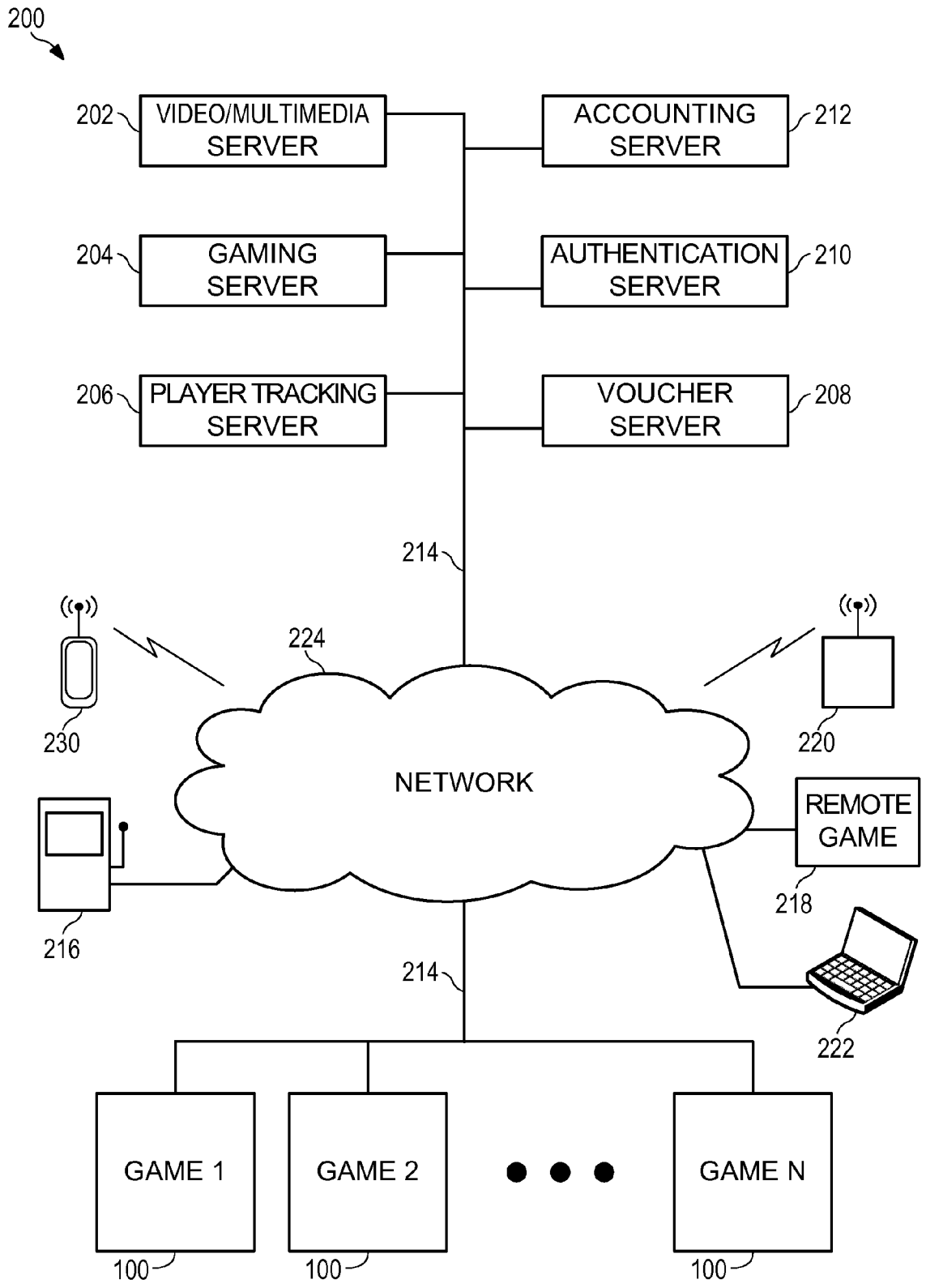
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a reel-of-one functionality, a payout functionality, a game play functionality, a game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.). Player tracking server 206 may be utilized for both the universal player tracking card system and/or one or more casino specific player tracking card systems.

Voucher server 208 may generate a voucher, which may include data relating to gaming. Further, the voucher may include payline structure option selections. In addition, the voucher may include player point data (e.g., balances, etc.), game play data (or similar game play data), reel-of-one data, repeat payline data, pattern data, historical payout data, column data, row data, and/or symbols that were modified.

Authentication server 210 may determine the validity of player cards, universal player cards, vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes. Accounting server 212 may generate one or more expense reports for the universal player tracking system and/or any other report (e.g., player's point balances, player point rankings, frequency of use, etc.).

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Figure 3:
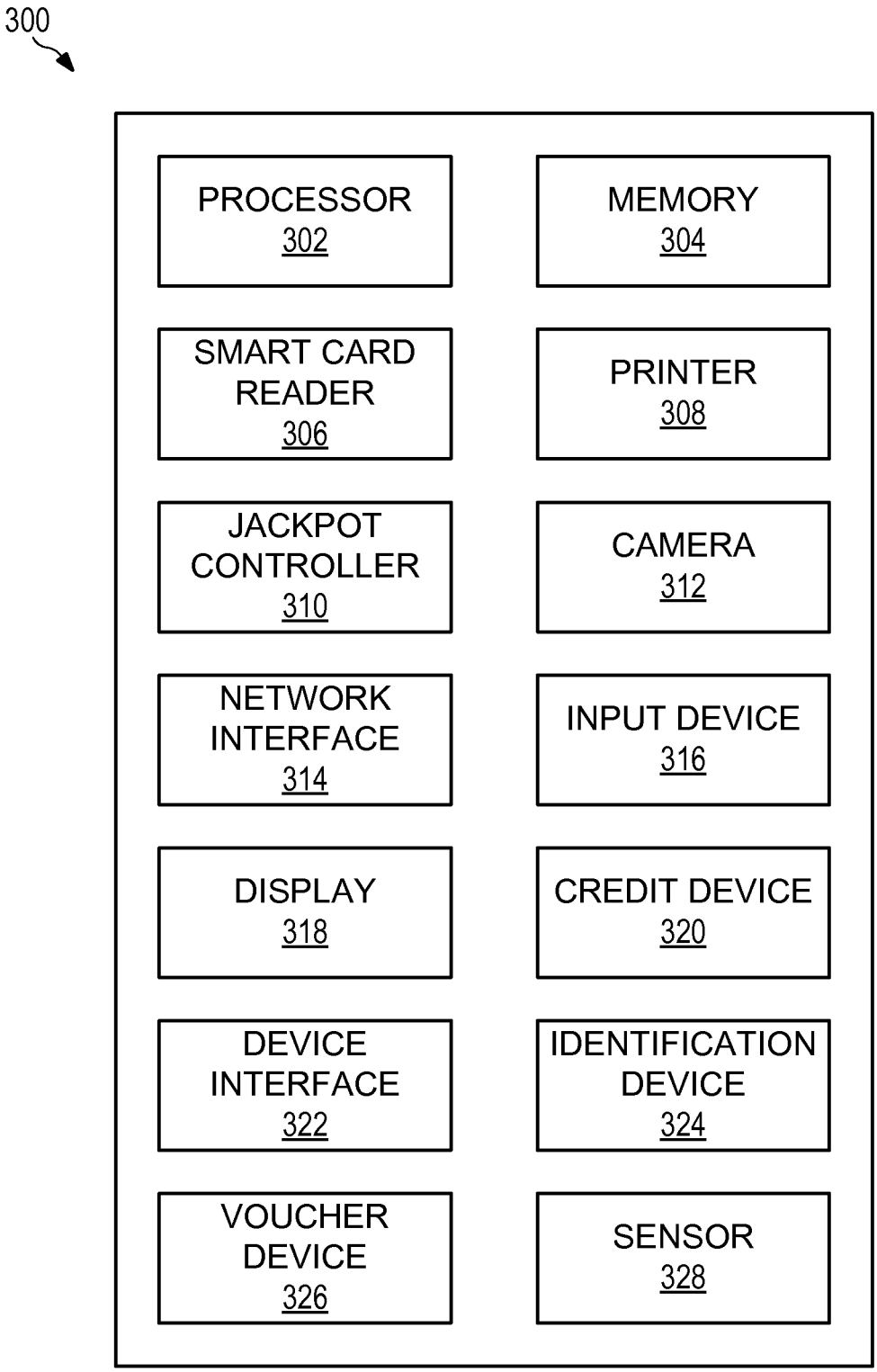
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. In one example, this image may be utilized to verify that the player's identity matches to the universal player's tracking card being utilized (e.g., photo on file is compared to image to ensure that the correct person is using the universal player's tracking card). For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof.

Input device 316 may be utilized to make a wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money, player points, and/or credits. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.). This information may include QR codes, other codes, and/or any other player data.

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data. For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, player point data, universal player point data, and/or any other wagering data. A voucher may represent an award, which may be used at other locations inside of the gaming establishment. For example, the voucher may be a coupon for the local buffet or a concert ticket.

Figure 4:
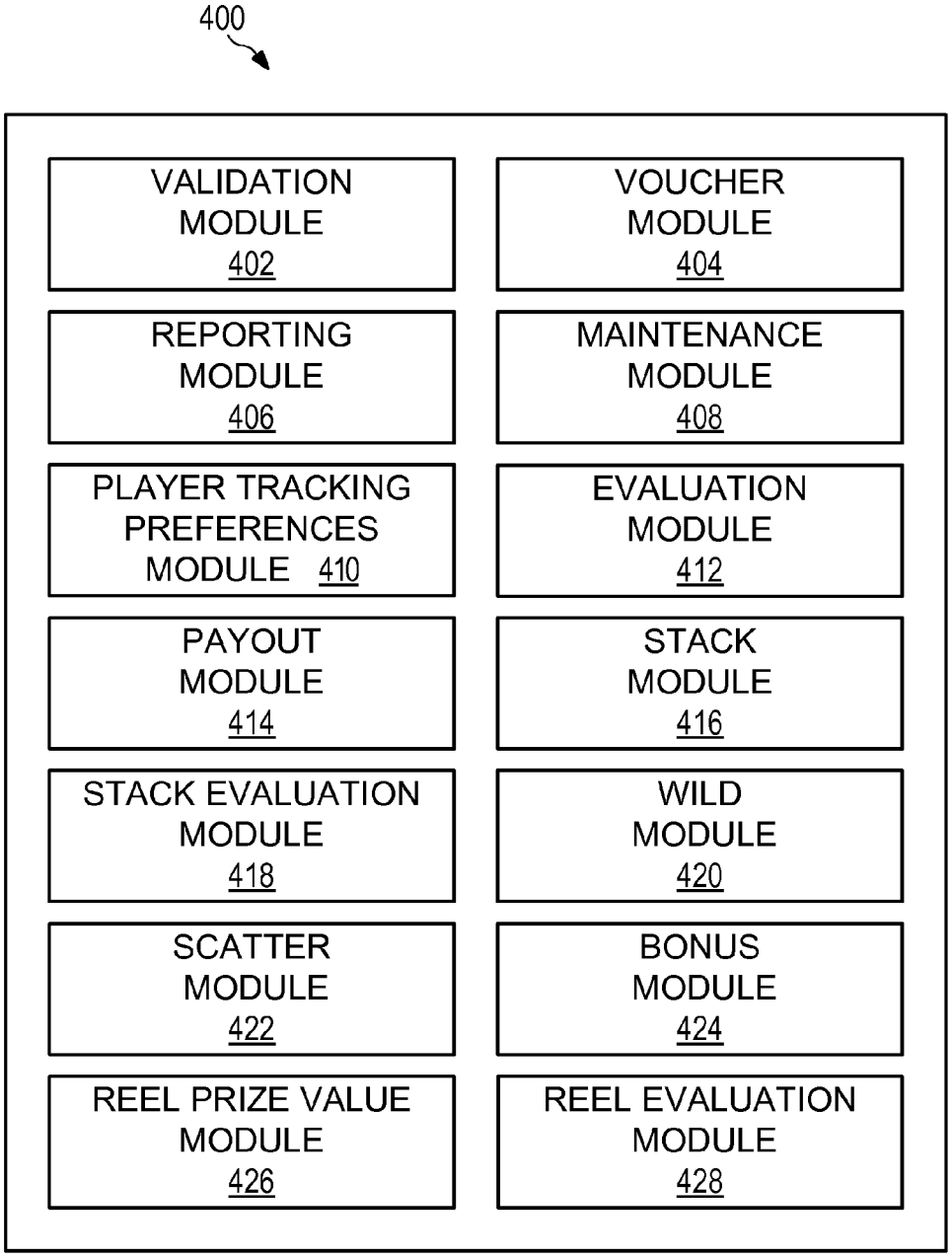
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an evaluation module 412, a payout module 414, a stack module 416, a stack evaluation module 418, a wild module 420, a scatter module 422, a bonus module 424, a reel prize value module 426, and/or a reel evaluation module 428.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Evaluation module 412 may evaluate one or more outcomes for one or more events relating to game play.

Payout module 414 may determine one or more payouts which may relate to one or more inputs received from the player, electronic gaming device 100, and/or electronic gaming system 200.

Stack module 416 may generate a stacking game, evaluate the results of the stacking game, trigger one or more stacking game presentations, generate stacking game payouts, and/or display any data relating to one or more stacking games. Stack module 416 may generate, implement, transmit, and/or store one or more symbol-of-one gaming functions.

Stack evaluation module 418 may evaluate one or more outcomes for one or more events relating to stacking game play. Stack evaluation module 418 may evaluate one or more outcomes for one or more events relating to one or more symbol-of-one game play.

Wild module 420 may generate a wild game, evaluate the results of the wild game, trigger wild game presentations, generate wild game payouts, and/or display any data relating to the wild game. Further, wild module 420 may determine one or more outcomes of one or more interactions (e.g., collisions of one or more symbols).

Scatter module 422 may generate a scatter game, evaluate the results of the scatter game, trigger scatter game presentations, generate scatter game payouts, and/or display any data relating to the scatter game.

Bonus module 424 may generate a bonus game, evaluate the results of the bonus game, trigger bonus game presentations, generate bonus game payouts, and/or display any data relating to the bonus game.

Reel prize value module 426 may generate a reel prize value, evaluate the results relating to the reel prize value, trigger one or more reel prize presentations, generate reel prize game payouts, and/or display any data relating to one or more reel prize (e.g., symbol-of-one) games.

Reel evaluation module 428 may evaluate one or more outcomes for one or more events relating to one or more symbol-of-one based gaming.

A promotional system may generate, compile, store, and/or transmit data relating to one or more promotions for one or more reel-of-one functionality game play.

It should be noted that one or more modules may be combined into one module. Further, there may be one evaluation module where the determined payout does not depend on whether there were any wild symbols, scatter symbols, platform based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
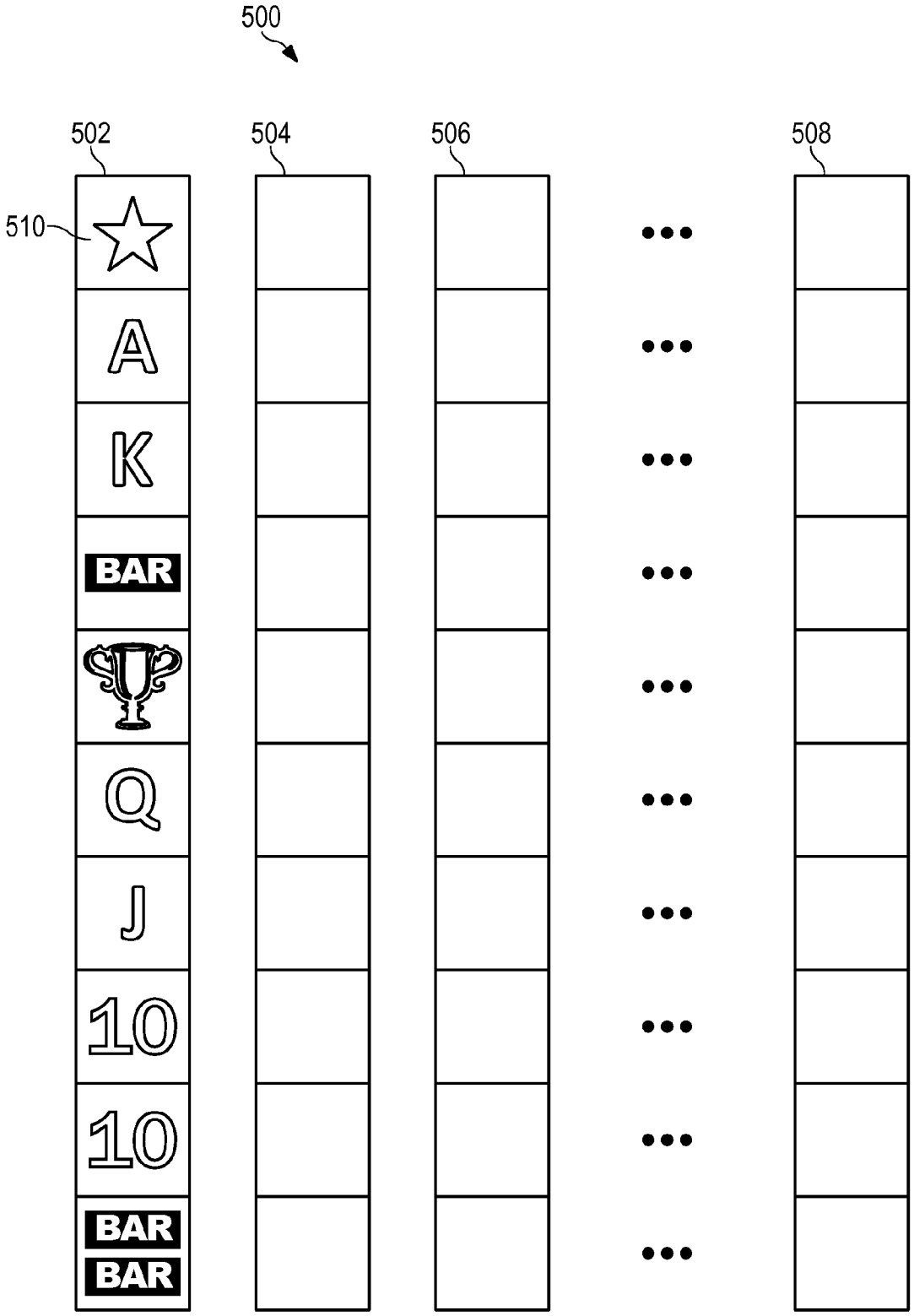
FIG. 5A is a diagram of reel strips, according to one embodiment.

In FIG. 5A, an illustration of a reel gaming option 500 on an exemplary gaming system is shown, according to one embodiment. The image includes a first reel 502, a second reel 504, a third reel 506, an Nth reel 508, and/or one or more symbols 510. One or more symbols 510 may be any symbol utilized in a gaming system and/or slot machine. Any reel (e.g., first reel 502, second reel 504, third reel 506, and/or Nth reel 508) may be utilized to illustrate parts of this disclosure. Further, any reel (e.g., first reel 502, second reel 504, third reel 506, and/or Nth reel 508) may be substituted for any other reel utilized to illustrate one or more feature of this disclosure.

Figure 5B:
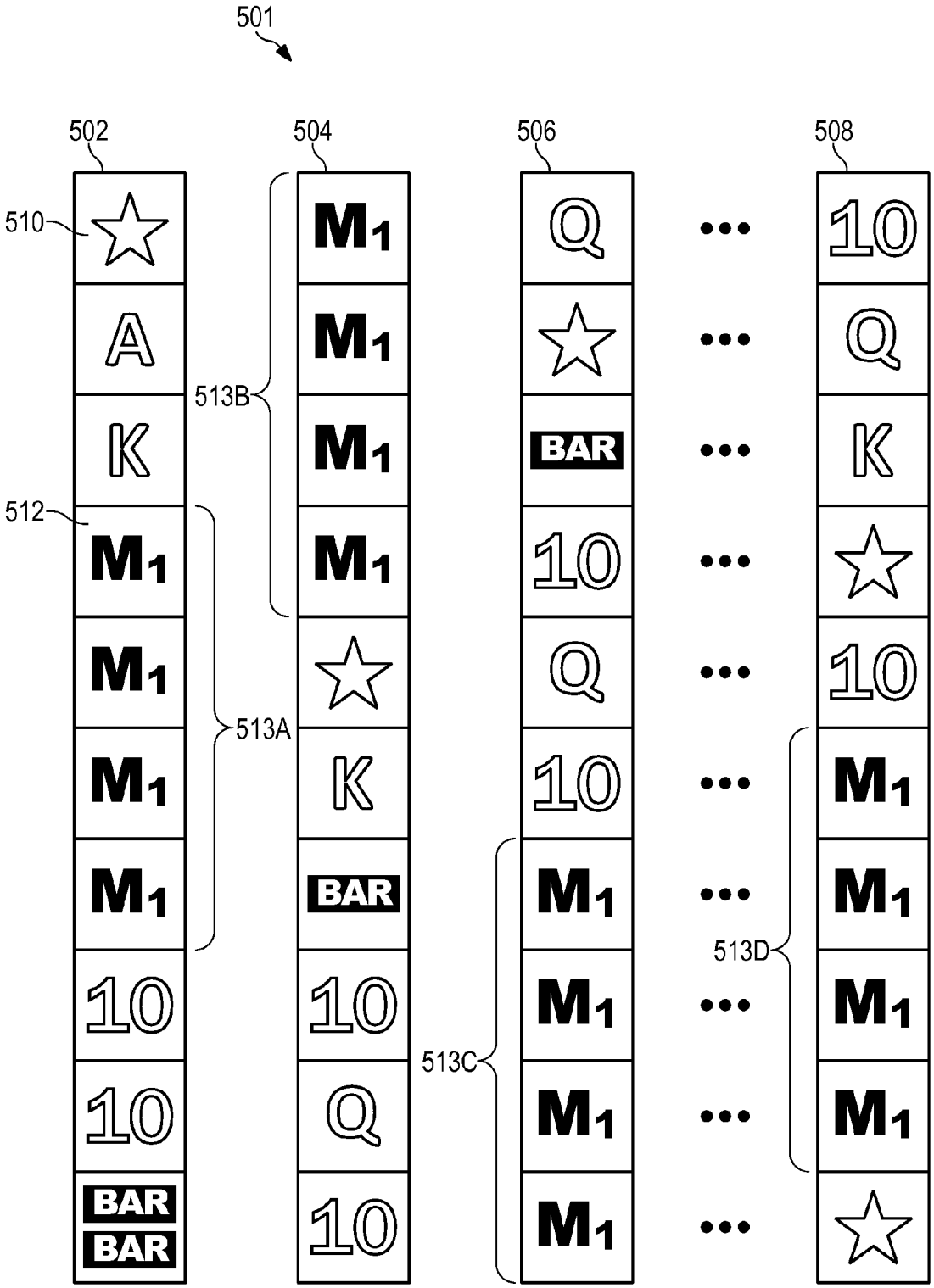
FIG. 5B is a diagram of reel strips with reel-of-one functionality, according to one embodiment.

In FIG. 5B, a diagram of reel strips with reel-of-one functionality 501 is shown, according to one embodiment. Image 501 may include first reel 502, second reel 504, third reel 506, and/or Nth reel 508. First reel 502, second reel 504, third reel 506, and/or Nth reel 508 may include one or more symbols 510. Further, first reel 502, second reel 504, third reel 506, and/or Nth reel 508 may include one or more reel-of-one symbols 512. Reel-of-one symbols 512 may be grouped together to form a first reel-of-one symbol grouping 513A, a second reel-of-one symbol grouping 513B, a third reel-of-one symbol grouping 513C, and/or an Nth reel-of-one symbol grouping 513D. In one example, first reel-of-one symbol grouping 513A includes four similar symbols (e.g., M1) located in the middle of the first reel. In another example, second reel-of-one symbol grouping 513B includes four similar symbols (e.g., M1) located at the top of the second reel. In another example, third reel-of-one symbol grouping 513C includes four similar symbols (e.g., M1) located at the bottom of the third reel. Further, Nth reel-of-one symbol grouping 513D includes four similar symbols (e.g., M1) located close to the bottom of the Nth reel. In this example, the reel-of-one symbol groupings all have the same number of symbols (e.g., 4). However, the number of symbols in the reel-of-one symbol groupings may vary between reels and may be any number. For example, a first reel-of-one symbol grouping may include 3 symbols. Whereas, a second reel-of-one symbol grouping may include 6 symbols. In another example, the symbols for each reel-of-one symbol grouping may be different. For example, an M1 symbol may be utilized in the first reel-of-one symbol grouping. Whereas, an M2 symbol may be utilized in the second reel-of-one symbol grouping. In addition, a Z3 symbol may be utilized in the Nth reel-of-one symbol grouping.

Figure 5C:
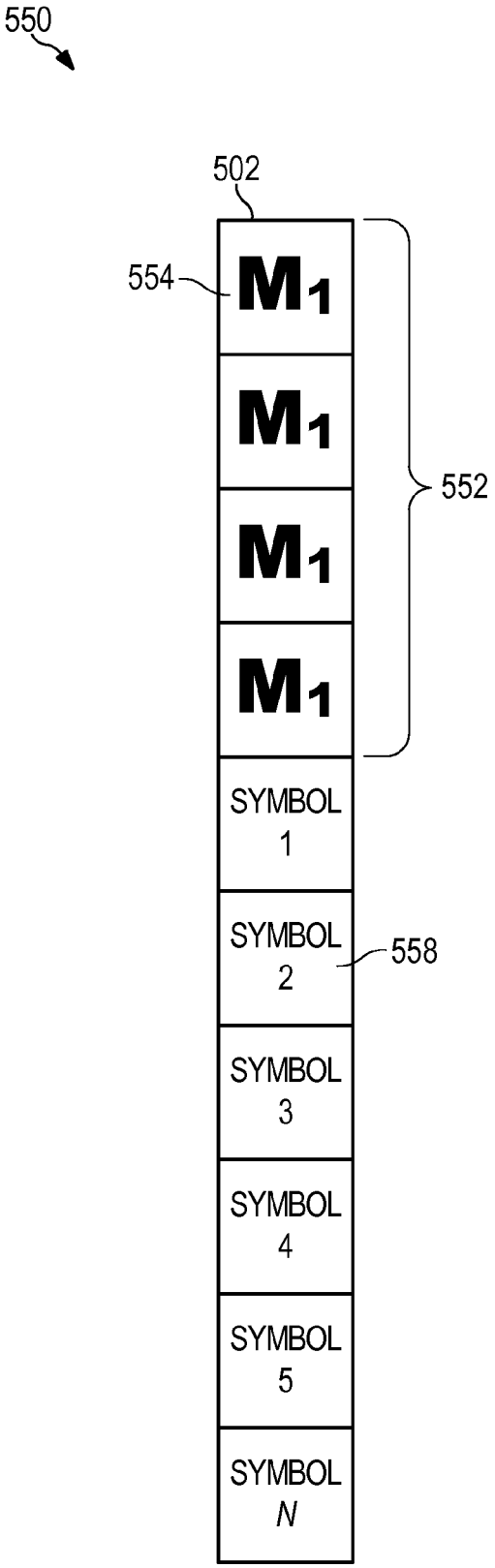
FIG. 5C is another diagram of a reel with reel-of-one functionality, according to one embodiment.

In FIG. 5C, another diagram of a reel with reel-of-one functionality 550 is shown, according to one embodiment. Image 550 may include first reel 502 with a group-of-one-symbol grouping 552 (which include a group-of-one symbol 554) and one or more non-group-of-one-symbols 558.

Figure 6A:
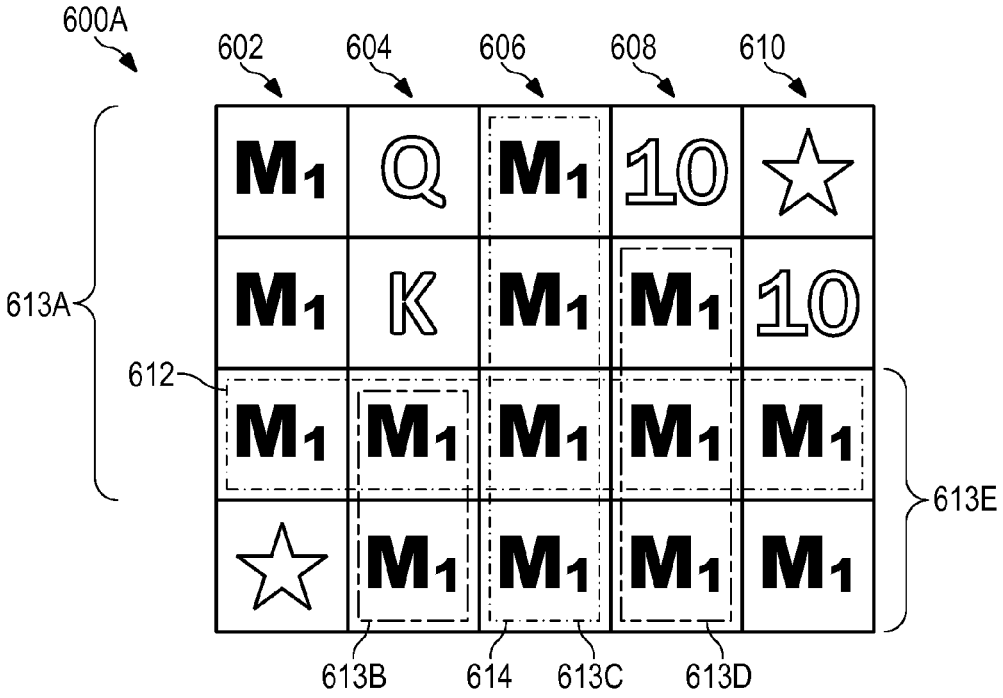
FIG. 6A is a diagram illustrating reel-of-one functionality on a plurality of symbol areas, according to one embodiment.

In FIG. 6A, a diagram illustrating reel-of-one functionality on a plurality of symbol areas 600A is shown, according to one embodiment. Image 600A may include a first reel 602, a second reel 604, a third reel 606, a fourth reel 608, and a fifth reel 610. Image 600A may also include a first reel-of-one symbol grouping 613A, a second reel-of-one symbol grouping 613B, a third reel-of-one symbol grouping 613C, a fourth reel-of-one symbol grouping 613D, a fifth reel-of-one symbol grouping 613E, a first winning combination 612, and a second winning combination 614.

In one example, first reel-of-one symbol grouping 613A may be the visible part of first reel-of-one symbol grouping 513A (see FIG. 5B). In another example, second reel-of-one symbol grouping 613B may be the visible part of second reel-of-one symbol grouping 513B (see FIG. 5B). In another example, third reel-of-one symbol grouping 613C may be the visible part of third reel-of-one symbol grouping 513C (see FIG. 5B). For clarity purposes, first reel-of-one symbol grouping 513A included four symbols (e.g., M1). In this example, only three of these symbols (e.g., M1) are shown on the display screen to form first reel-of-one symbol grouping 613A. However, the fourth symbol (e.g., M1) is still present on the reel but is not displayed in the visible area of the display screen. The fourth symbol (e.g., M1) is located above the three M1 symbol grouping (e.g., first reel-of-one symbol grouping 613A) but is not displayed because the display area does not include the area where the fourth M1 symbol is located. In another example, second reel-of-one symbol grouping 513B included four symbols (e.g., M1). In this example, only two of these symbols (e.g., M1) are shown on the display screen to form second reel-of-one symbol grouping 613B. However, the third symbol (e.g., M1) and the fourth symbol (e.g., M1) is located below the two M1 symbol grouping (e.g., second reel-of-one symbol grouping 613B) but are not displayed because the display area does not include the area where the third M1 symbol and the fourth M1 symbols are located.

In one example, first winning combination 612 includes five M1 symbols located in the third row. This first winning combination 612 includes five adjacent M1 symbols with one M1 symbols located in each reel. In another example, second winning combination 614 includes five M1 symbols located in the third column (e.g., third reel 606). Second winning combination 614 may completely fill third reel 606 with M1 symbols.

Figure 6B:
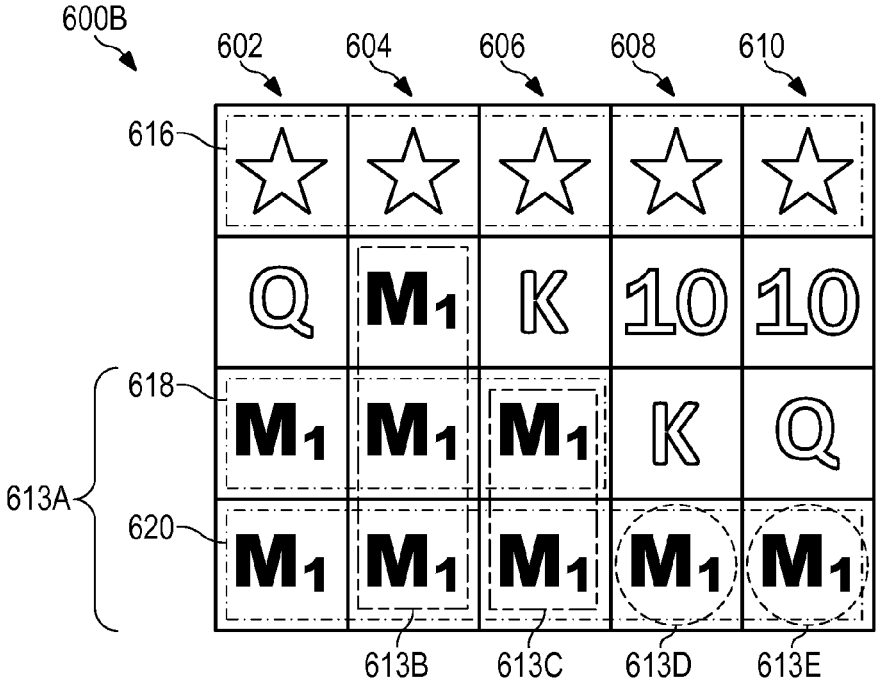
FIG. 6B is another diagram illustrating reel-of-one functionality on a plurality of symbol areas, according to one embodiment.

In FIG. 6B, another diagram illustrating reel-of-one functionality on a plurality of symbol areas 600B is shown, according to one embodiment. Image 600B may include first reel-of-one symbol grouping 613A, second reel-of-one symbol grouping 613B, third reel-of-one symbol grouping 613C, fourth reel-of-one symbol grouping 613D, fifth reel-of-one symbol grouping 613E, a third winning combination 616, a fourth winning combination 618, and a fifth winning combination 620. In another example, first reel-of-one symbol grouping 613A may be the visible part of first reel-of-one symbol grouping 513A (see FIG. 5B). In another example, second reel-of-one symbol grouping 613B may be the visible part of second reel-of-one symbol grouping 513B (see FIG. 5B). In another example, third reel-of-one symbol grouping 613C may be the visible part of third reel-of-one symbol grouping 513C (see FIG. 5B). For clarity purposes, first reel-of-one symbol grouping 513A included four symbols (e.g., M1). In this example, only two of these symbols (e.g., M1) are shown on the display screen to form first reel-of-one symbol grouping 613A. However, the third symbol (e.g., M1) and the fourth symbol (e.g., M1) are still present on the reel but are not displayed in the visible area. The third symbol (e.g., M1) and the fourth symbol (e.g., M1) are located below the two M1 symbol grouping (e.g., first reel-of-one symbol grouping 613A) but are not displayed because the display area does not include the area where the third M1 symbol and the fourth M1 symbol are located. In another example, second reel-of-one symbol grouping 513B included four symbols (e.g., M1). In this example, only three of these symbols (e.g., M1) are shown on the display screen to form second reel-of-one symbol grouping 613B. However, the fourth symbol (e.g., M1) is located below the three M1 symbol grouping (e.g., second reel-of-one symbol grouping 613B) but are not displayed because the display area does not include the area where the third M1 symbol is located. In another example, third winning combination 616 may include five non-reel-of-one symbols located adjacent to each other in the first row. These five stars (e.g., non-reel-of-one symbols) having one star located in each reel. These five stars may generate a first non-reel-of-one symbol payout. In another example, fourth winning combination 618 may include three reel-of-one symbols (e.g., M1) located in the third row with one M1 symbol located in each of the first reel, the second reel, and the third reel. In another example, fifth winning combination 620 may include five reel-of-one symbols (e.g., M1) located in the fourth row with one M1 symbol located in each of the reels (e.g., first reel, second reel, third reel, fourth reel, and fifth reel).

Figures 7A, 7B:
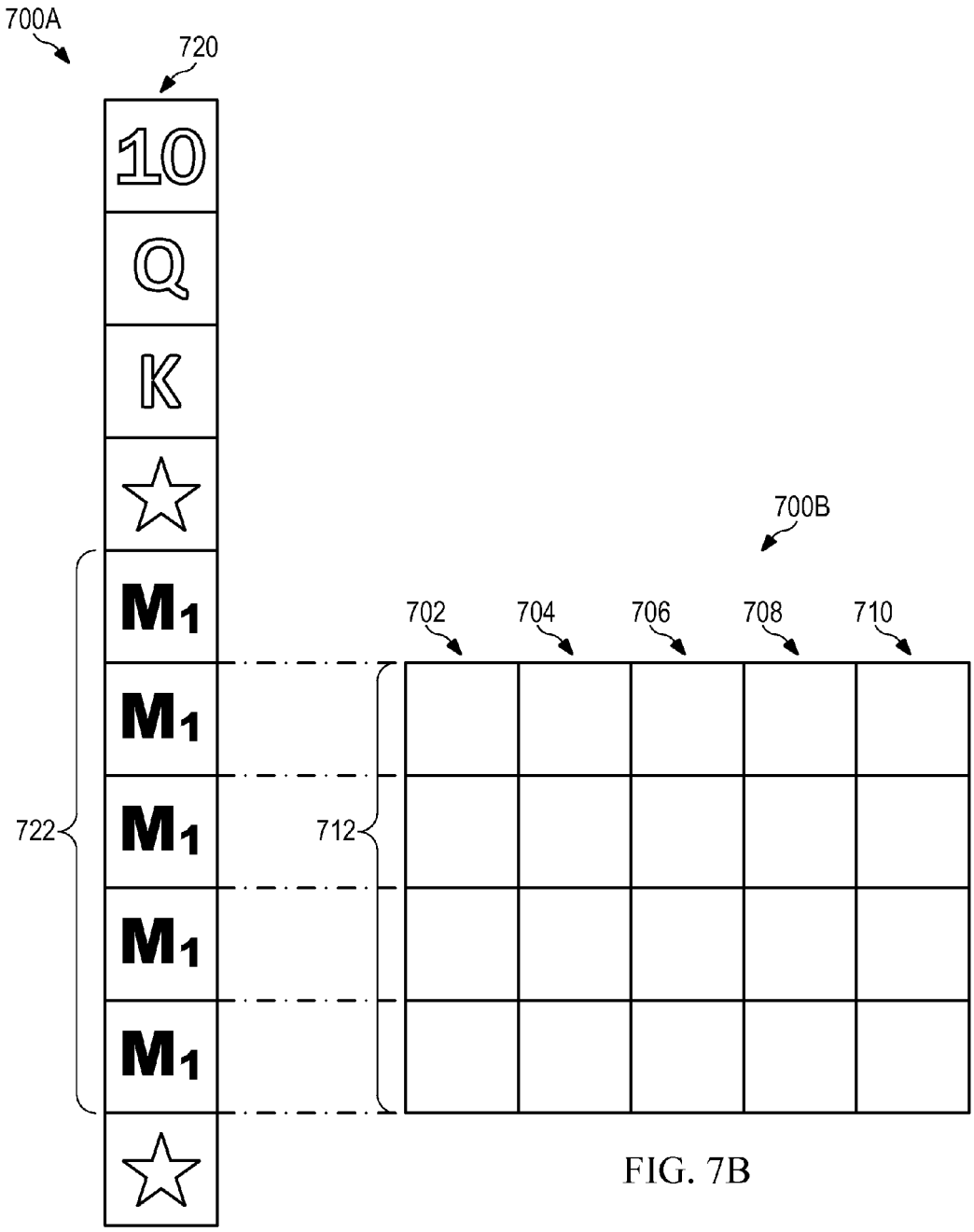
FIG. 7A is a diagram illustrating reel-of-one functionality on a plurality of symbol areas, according to one embodiment.
FIG. 7B is another diagram illustrating reel-of-one functionality on a plurality of symbol areas, according to one embodiment.

In FIG. 7A, a diagram illustrating reel-of-one functionality on a plurality of symbol areas 700A is shown, according to one embodiment. Image 700A may include a reel 720 where reel 720 includes one or more symbols 510 and a reel-of-one symbol grouping 722. Reel-of-one symbol grouping 722 may be one or more reel-of-one symbol groupings. In this example, reel-of-one symbol grouping 722 may include five symbols (e.g., M1). In various examples, reel-of-one symbol grouping 722 may include any number of symbols (e.g., 1-N). Further, reel-of-one symbol grouping 722 may include more symbols then may be displayed on a first reel display area 702, a second reel display area 704, a third reel display area 706, a fourth reel display area 708, and/or a fifth reel display area 710. In this example, first reel display area 702, second reel display area 704, third reel display area 706, fourth reel display area 708, and/or fifth reel display area 710 may have four areas that are displayed on electronic gaming device 100 (see FIG. 7B). First reel, second reel, third reel, fourth reel, fifth reel, and/or Nth reel may have any number of symbol areas (e.g., 1-N) with reel display areas that have any number of reel display areas (e.g., 1-N). In various examples, first reel display area 702, second reel display area 704, third reel display area 706, fourth reel display area 708, and/or fifth reel display area 710 may have identical number of symbol areas (e.g., 1, 2, 3, 4, etc.) and/or varying number of symbol areas (e.g., first reel display area 702=4 symbols in the area, second reel display area 704=5 symbols in the area, third reel display area 706=3 reel-of-one symbols in the area, fourth reel display area 708=4 reel-of-one symbols in the area, and fifth reel display area 710=6 reel-of-one symbols in the area). For example, the middle reels of a gaming device may have larger reel-of-one symbol areas to increase the probability of larger reel-of-one symbol groupings in the middle of the display. In another example, the outside reels of a gaming device may have larger reel-of-one symbol areas to increase the probability of larger reel-of-one symbol groupings at the outside areas. Further, the size of the reel-of-one symbol groupings may vary to target one or more target payouts, payout volatility, and/or one or more players' preferences.

Figure 8:
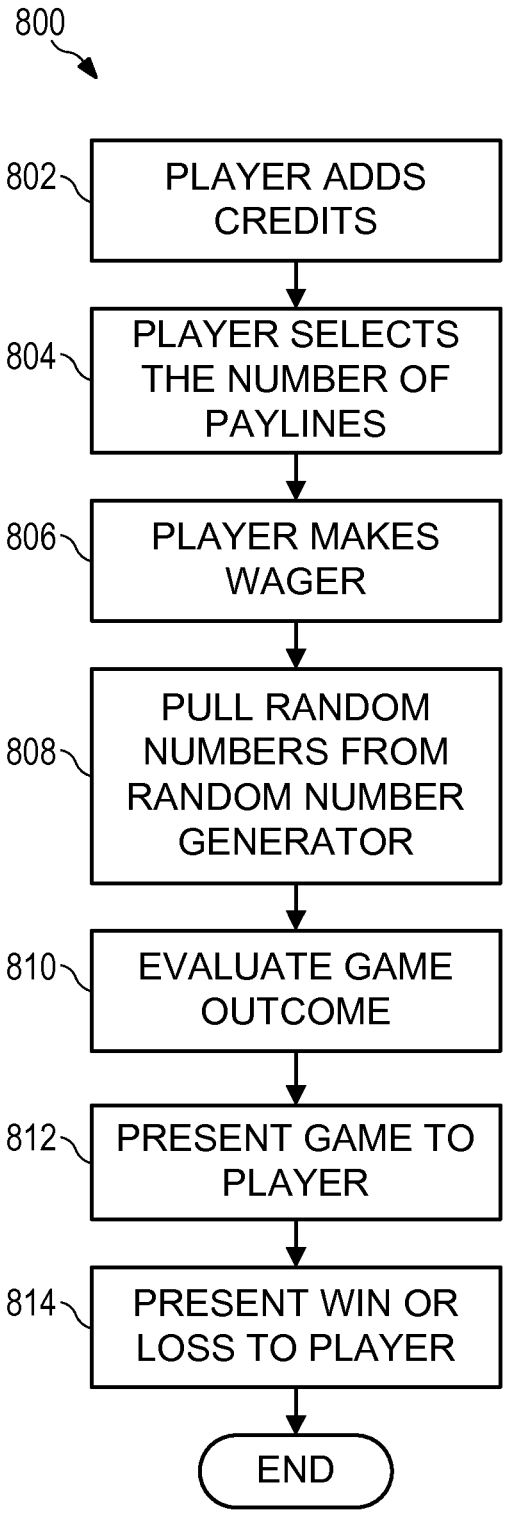
FIG. 8 is a flow diagram for game play, according to one embodiment.

FIG. 8 is a process flowchart of one example of a primary game play 800 on an electronic gaming system, according to one embodiment. The method may include the step of a player adding credit to the electronic gaming system (step 802). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 804, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 806, the player makes a wager on the game. In one embodiment, the wager may be a multiple of the number of paylines selected at step 804. In another embodiment, the wager may not be a multiple of the number of paylines selected at step 804. In a further embodiment, the wager may include a side-wager (e.g., ante bet), which may, in one example of such an embodiment, be used to make the player eligible to be awarded the extra functionality discussed above. It should be appreciated that in some embodiments, the order of steps 804 and 806 may be not critical, and so for example, a player can select the wager they wish to place, and then select the number of paylines they want it applied to, and that these embodiments are expressly contemplated as being within the scope of the present disclosure.

Continuing to step 808, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 810 and 812, the gaming system utilizes the random numbers pulled at step 808 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 814, the win or loss outcome may be identified for the player. In one embodiment, this step can include additional messaging, which provides information related to the win or loss, such as why the player won or lost. In another embodiment, this step can include identification of the amount of any award earned by the player.

Figure 9:
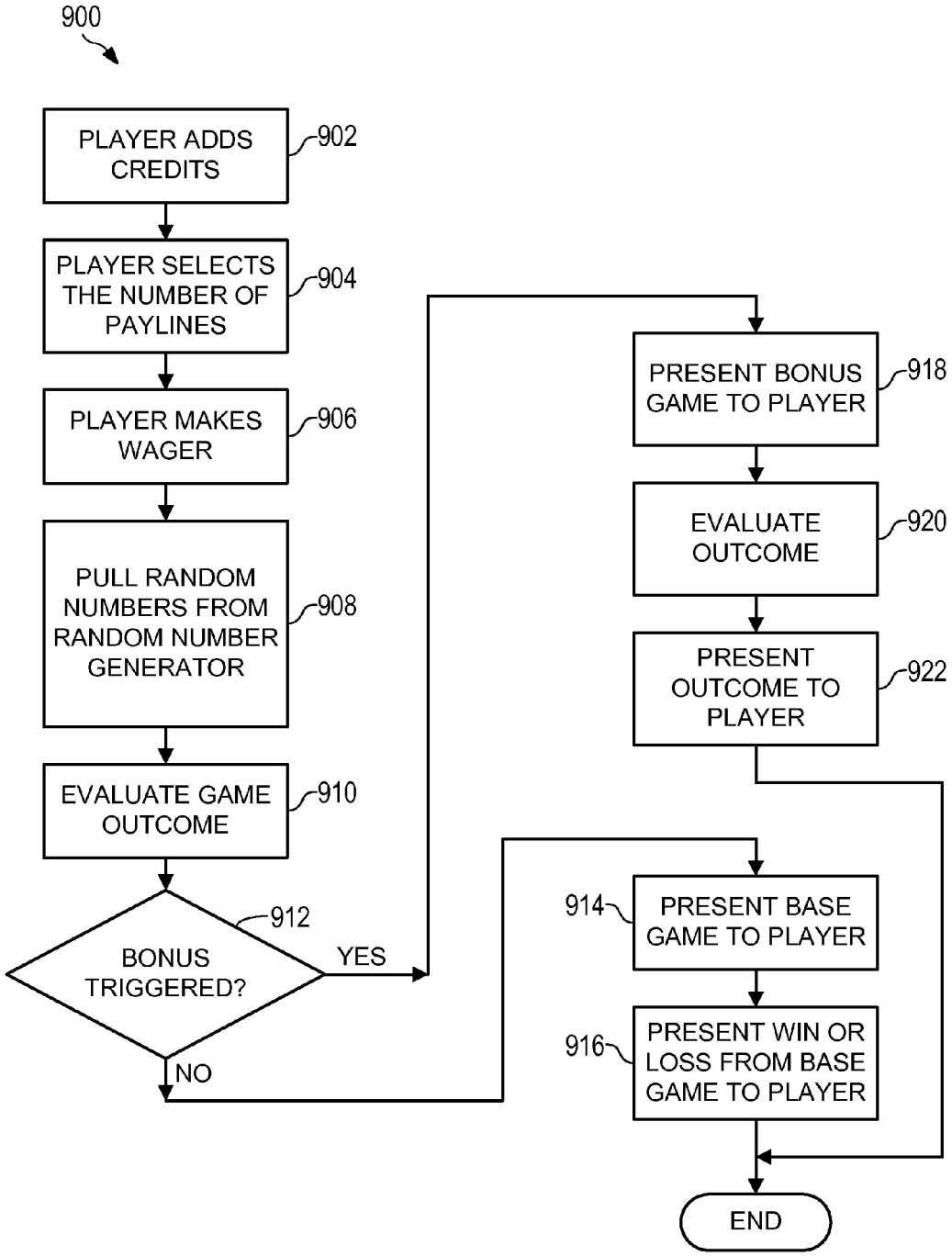
FIG. 9 is another flow diagram for game play, according to one embodiment.

FIG. 9 is a process flowchart of one example of a combined primary and secondary game play 900 on an electronic gaming system, according to one embodiment. The method may include the step of a player adding credit to the electronic gaming system (step 902). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 904, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 906, the player makes a wager on the game. In one embodiment, the wager may be a multiple of the number of paylines selected at step 904. In another embodiment, the wager may not be a multiple of the number of paylines selected at step 904. In a further embodiment, the wager may include a side-wager, which may, in one example of such an embodiment, be used to make the player eligible to be awarded the extra functionality discussed above. It should be appreciated that in some embodiments, the order of steps 904 and 906 may be not critical, and so for example, a player can select the wager they wish to place, and then select the number of paylines they want it applied to, and that these embodiments may be expressly contemplated as being within the scope of the present disclosure.

Continuing to step 908, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 910, the gaming system utilizes the random numbers pulled at step 908 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 912, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 914, where the base game may be fully presented to the player. As discussed above, the orders of step 910, 912, and 914 can be changed without affecting the novel concepts disclosed herein.

At step 916, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 912 that a bonus or secondary game was triggered, then process 900 continues to step 918, where the secondary game may be presented to the player. As discussed above, there are numerous ways to present the secondary or bonus game to the player.

At steps 920 and 922, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 900 ending after step 922, the process continues to step 914 so as to finalize the primary game outcome presentation to the player.

Figure 10A:
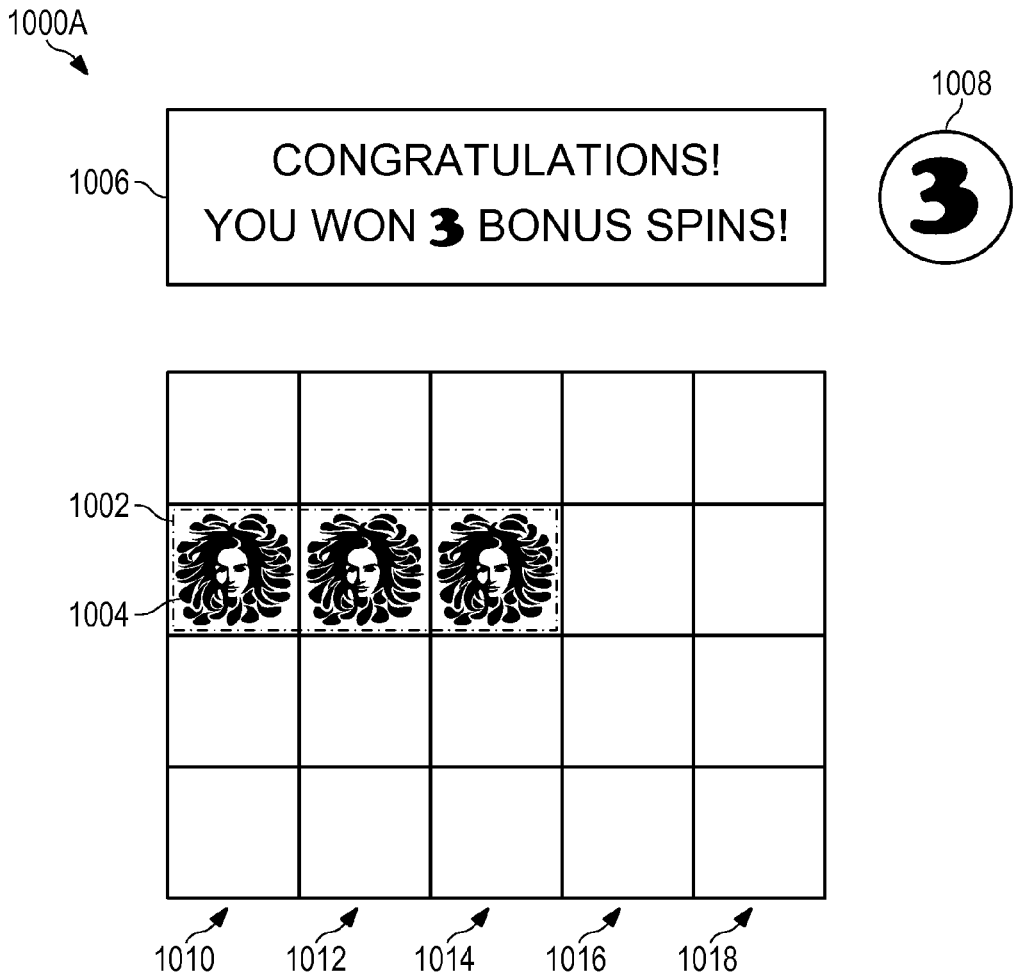
FIG. 10A is another diagram illustrating reel-of-one functionality on a plurality of symbol areas, according to one embodiment.

In FIG. 10A, another diagram illustrating reel-of-one functionality on a plurality of symbol areas 1000A is shown, according to one embodiment. Image 1000A may include a winning combination 1002 with one or more symbols 1002. Further, image 1000A may include a message area 1006, a bonus spin counter 1008, a first reel area 1010, a second reel area 1012, a third reel area 1014, a fourth reel area 1016, and a fifth reel area 1018. Winning combination 1002 may include three symbols being location on three adjacent reels (e.g., first reel area 1010, second reel area 1012, and third reel area 1014). In this example, message area 1006 may state "CONGRATULATIONS! YOU WON 3 BONUS SPINS!" Bonus spin counter 1008 may indicate that three bonus spins have been won by showing a 3 in bonus spin counter 1008. Winning combination 1002 may be based on one or more non-reel-of-one symbols, reel-of-one symbols, and/or any combination thereof.

Figure 10B:
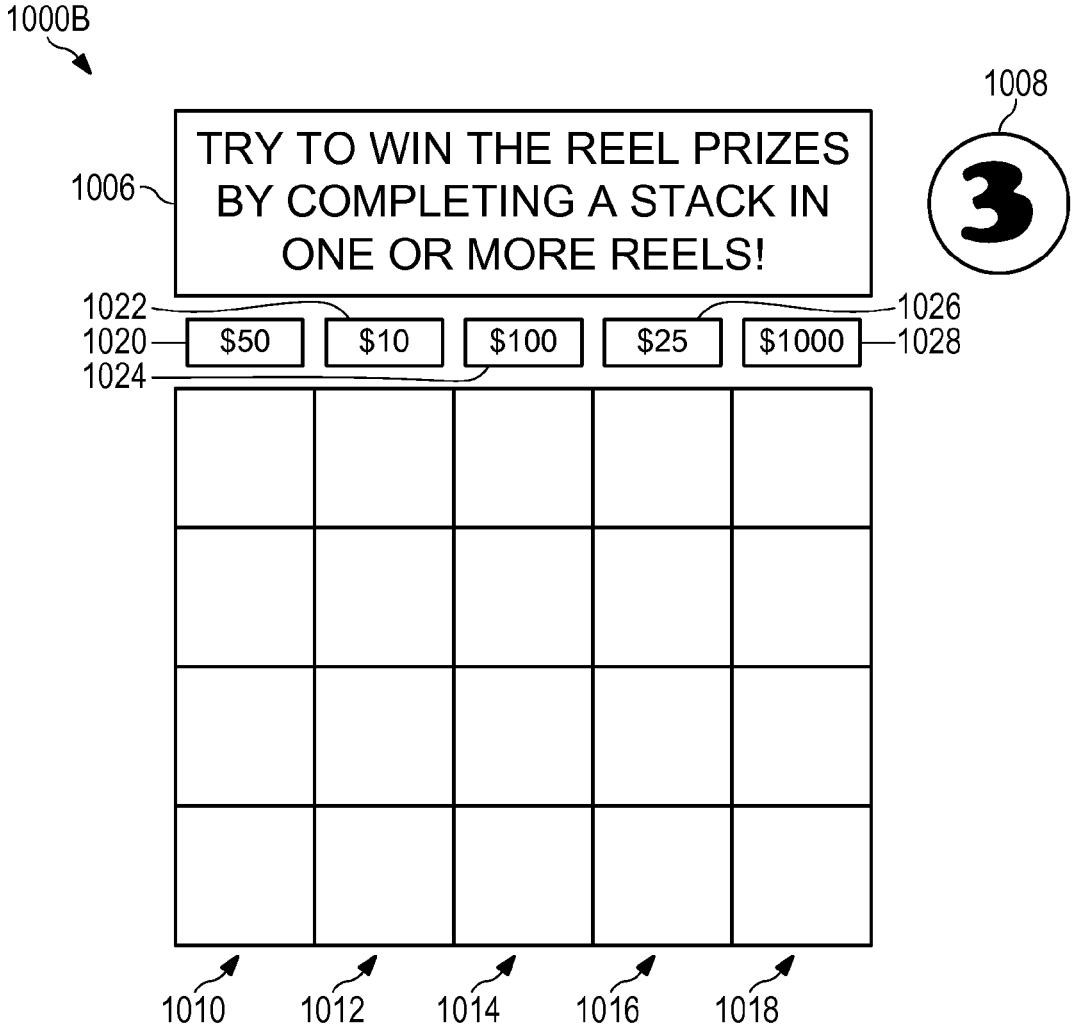
FIG. 10B is another diagram illustrating reel-of-one functionality on a plurality of symbol areas, according to one embodiment.

In FIG. 10B, another diagram illustrating reel-of-one functionality on a plurality of symbol areas 1000B is shown, according to one embodiment. Image 1000B may include message area 1006, bonus spin counter 1008, a first reel jackpot 1020, a second reel jackpot 1022, a third reel jackpot 1024, a fourth reel jackpot 1026, and a fifth reel jackpot 1028. In one example, first reel jackpot 1020 may be worth $50. In another example, second reel jackpot 1022 may be worth $10. In another example, third reel jackpot 1024 may be worth $100. In a further example, fourth reel jackpot 1026 may be worth $25. In addition, fifth reel jackpot 1028 may be worth $1000. In this example, message area 1006 may state "TRY TO WIN THE REEL PRIZES BY COMPLETING A STACK IN ONE OR MORE REELS!" Bonus spin counter 1008 may display a 3 to indicate that the player has 3 bonus spins remaining. EXAMPLES OF HOW YOU WIN AND REFERENCE OTHER FIGURES.

Figure 10C:
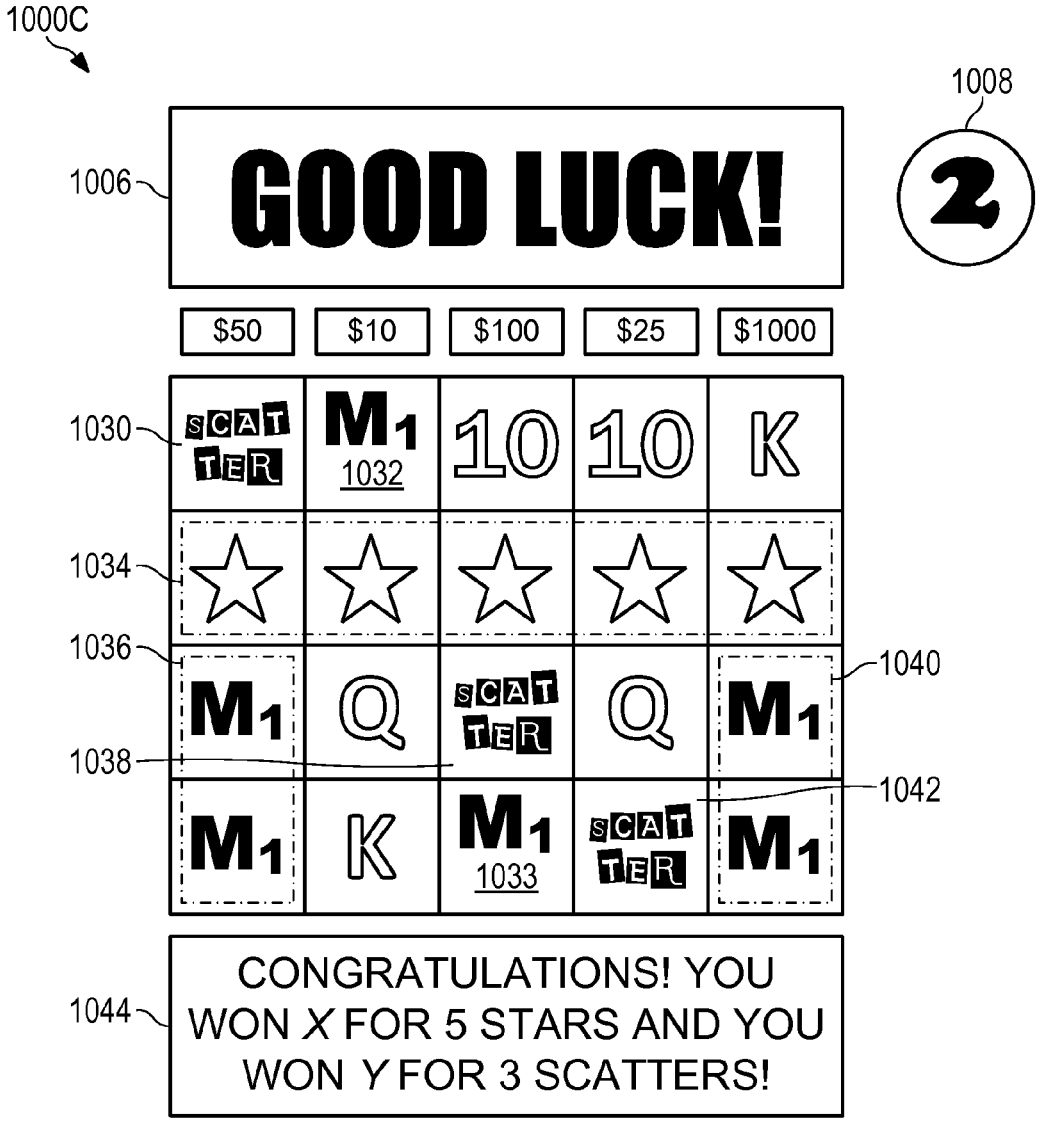
FIG. 10C is another diagram illustrating reel-of-one functionality on a plurality of symbol areas, according to one embodiment.

In FIG. 10C, another diagram illustrating reel-of-one functionality on a plurality of symbol areas 1000C is shown, according to one embodiment. Image 1000C may include message area 1006, bonus spin counter 1008, first reel jackpot 1020 (e.g., $50), second reel jackpot 1022 (e.g., $10), third reel jackpot 1024 (e.g., $100), fourth reel jackpot 1026 (e.g., $25), fifth reel jackpot 1028 (e.g., $1000), a second message area 1044, a scatter winning combination (e.g., a first scatter 1030, a second scatter 1038, and a third scatter 1042), a star winning combination 1034, a first symbol grouping 1036, a second symbol grouping 1032, a third symbol grouping 1033, and a fifth symbol grouping 1040.

In this example, bonus spin counter 1008 has been reduced by 1 to 2 spins to indicate that the player has utilized one of the player's free spins. Second message area 1044 may state "CONGRATULATIONS! YOU WON X FOR 5 STARS AND YOU WON Y FOR 3 SCATTERS!" Further, message area 1006 may state "GOOD LUCK!" Example all winning and non-winning situations.

Figure 10D:
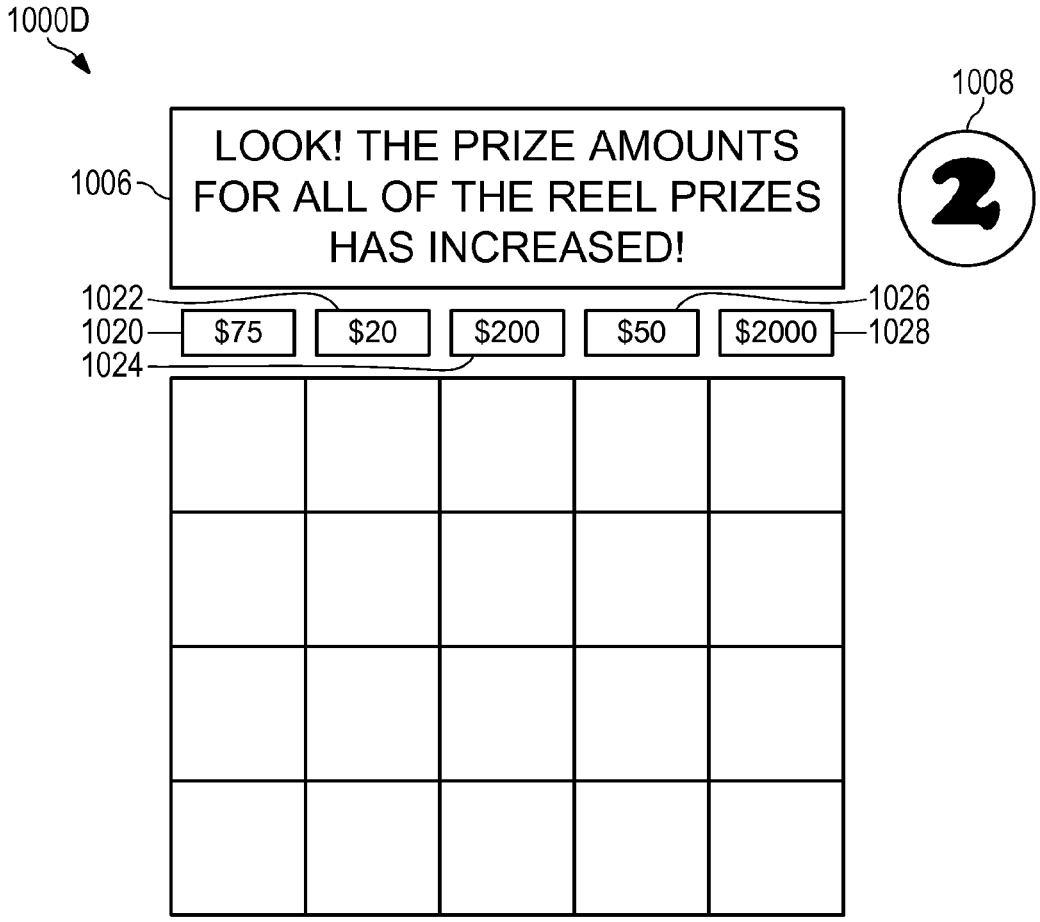
FIG. 10D is another diagram illustrating reel-of-one functionality on a plurality of symbol areas, according to one embodiment.

In FIG. 10D, another diagram illustrating reel-of-one functionality on a plurality of symbol areas 1000D is shown, according to one embodiment. Image 1000D may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may be increased from $50 to $75. In another example, second reel jackpot 1022 may be increased from $10 to $20. In another example, third reel jackpot 1024 may be increased from $100 to $200. Further, fourth reel jackpot 1026 may be increased from $25 to $50. In addition, fifth reel jackpot 1028 may be increased from $1,000 to $2,000. In these examples, some of the reel prizes have increased by 100% (e.g., second reel jackpot 1022, third reel jackpot 1024, fourth reel jackpot 1026, fifth reel jackpot 1028, etc.) while other reel prizes have been increased by 50% (e.g., first reel jackpot 1020, etc.). In various examples, any percentage (e.g., 1%, 5%, 10%, 25%, 50%, 51%, 100%, etc.) may be utilized to increase and/or decrease any reel prize. Further, any absolute dollar number may be utilized. In various examples, $1, $5, $10, $25, $100, $400, $10,000, etc. may be utilized.

Figure 10E:
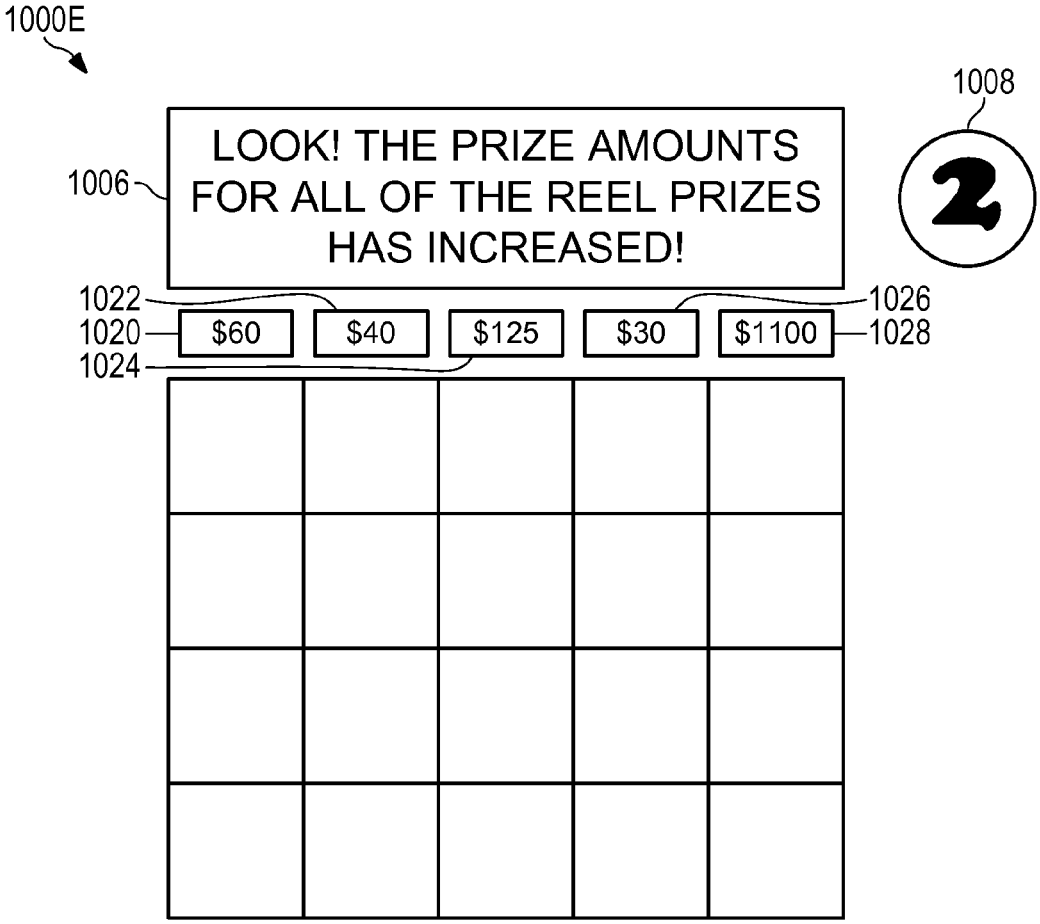
FIG. 10E is another diagram illustrating reel-of-one functionality on a plurality of symbol areas, according to one embodiment.

In FIG. 10E, another diagram illustrating reel-of-one functionality on a plurality of symbol areas 1000E is shown, according to one embodiment. Image 1000E may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may be increased from $50 to $60. In another example, second reel jackpot 1022 may be increased from $10 to $40. In another example, third reel jackpot 1024 may be increased from $100 to $125. Further, fourth reel jackpot 1026 may be increased from $25 to $30. In addition, fifth reel jackpot 1028 may be increased from $1,000 to $1,100. In these examples, first reel jackpot 1020 was increased by 20% and/or an absolute dollar amount of $10. Further, second reel jackpot 1022 was increased by 400% and/or an absolute dollar amount of $30. In addition, third reel jackpot 1024 was increased by 25% and/or an absolute dollar amount of $25. Further, fourth reel jackpot 1026 was increased by 20% and/or an absolute dollar amount of $5. Lastly, fifth reel jackpot 1028 was increased by 10% and/or an absolute dollar amount of $100. Message area 1006 may state "LOOK! THE PRIZES AMOUNTS FOR ALL OF THE REEL PRIZES HAS INCREASED!"

Figure 10F:
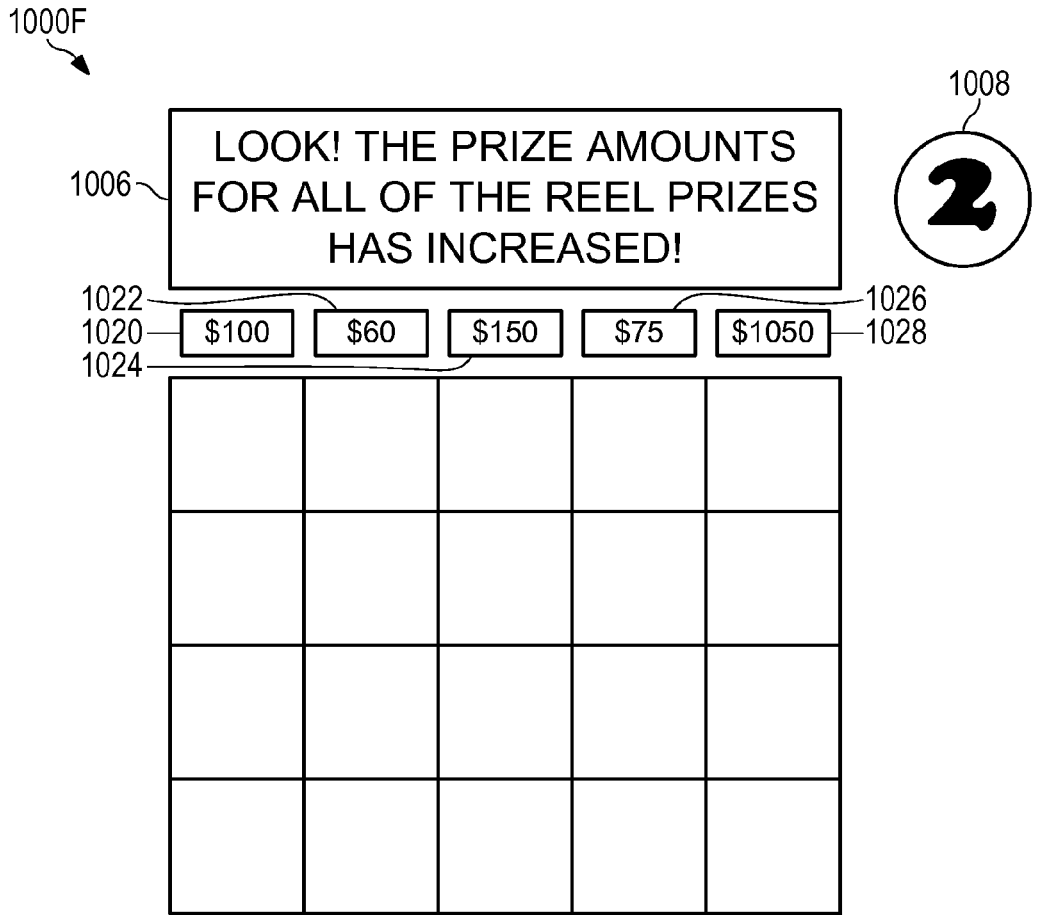
FIG. 10F is another diagram illustrating reel-of-one functionality on a plurality of symbol areas, according to one embodiment.

In FIG. 10F, another diagram illustrating reel-of-one functionality on a plurality of symbol areas 1000F is shown, according to one embodiment. Image 1000F may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may be increased from $50 to $100. In another example, second reel jackpot 1022 may be increased from $10 to $60. In another example, third reel jackpot 1024 may be increased from $100 to $150. Further, fourth reel jackpot 1026 may be increased from $25 to $75. In addition, fifth reel jackpot 1028 may be increased from $1,000 to $1,050. In these examples, first reel jackpot 1020 was increased by 100% and/or an absolute dollar amount of $50. Further, second reel jackpot 1022 was increased by 600% and/or an absolute dollar amount of $50. In addition, third reel jackpot 1024 was increased by 50% and/or an absolute dollar amount of $50. Further, fourth reel jackpot 1026 was increased by 300% and/or an absolute dollar amount of $50. Lastly, fifth reel jackpot 1028 was increased by 5% and/or an absolute dollar amount of $50. Message area 1006 may state "LOOK! THE PRIZES AMOUNTS FOR ALL OF THE REEL PRIZES HAS INCREASED!"

Figure 10G:
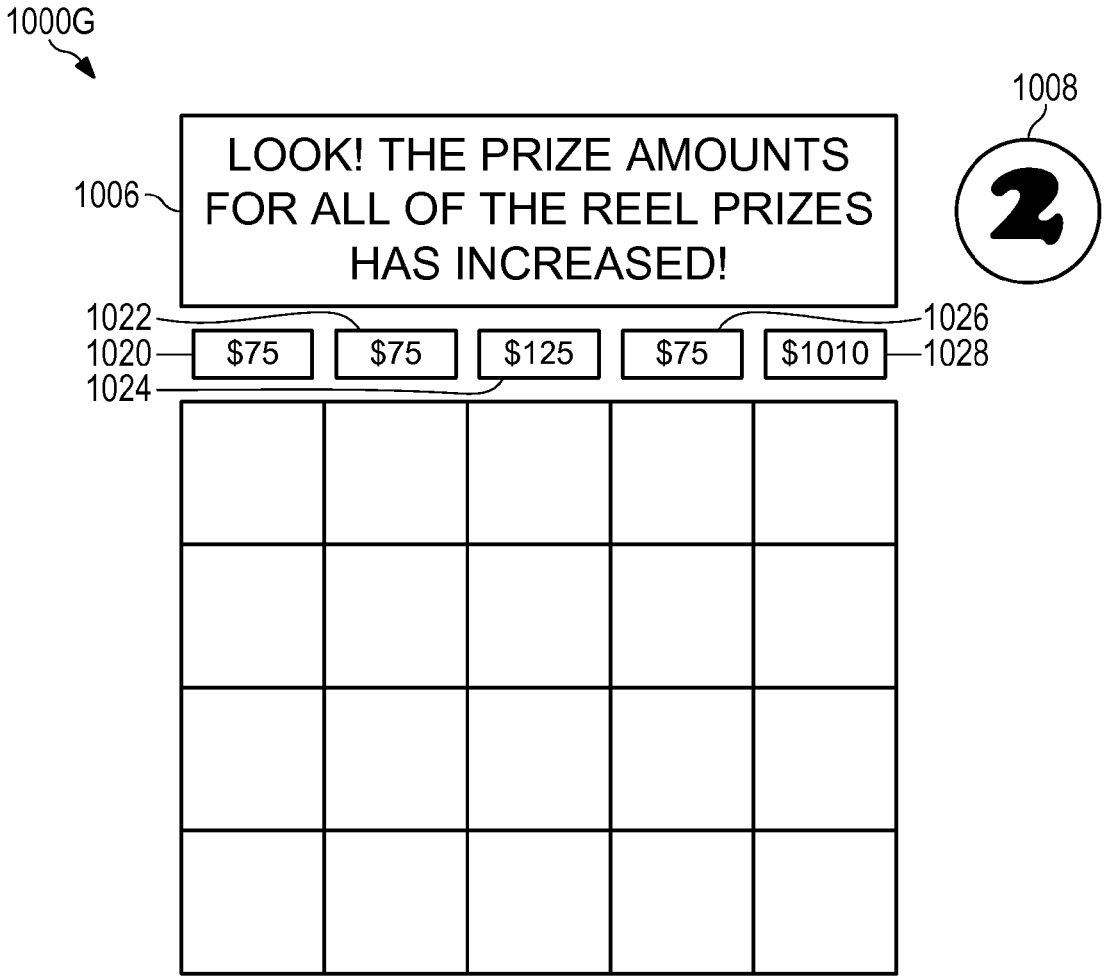
FIG. 10G is another diagram illustrating reel-of-one functionality on a plurality of symbol areas, according to one embodiment.

In FIG. 10G, another diagram illustrating reel-of-one functionality on a plurality of symbol areas 1000G, according to one embodiment. Image 1000G may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may be increased from $50 to $75. In another example, second reel jackpot 1022 may be increased from $10 to $75. In another example, third reel jackpot 1024 may be increased from $100 to $125. Further, fourth reel jackpot 1026 may be increased from $25 to $75. In addition, fifth reel jackpot 1028 may be increased from $1,000 to $1,010. In these examples, first reel jackpot 1020 was increased by 50% and/or an absolute dollar amount of $25. Further, second reel jackpot 1022 was increased by 750% and/or an absolute dollar amount of $65. In addition, third reel jackpot 1024 was increased by 25% and/or an absolute dollar amount of $25. Further, fourth reel jackpot 1026 was increased by 300% and/or an absolute dollar amount of $50. Lastly, fifth reel jackpot 1028 was increased by 1% and/or an absolute dollar amount of $10. Message area 1006 may state "LOOK! THE PRIZES AMOUNTS FOR ALL OF THE REEL PRIZES HAS INCREASED!"

Figure 10H:
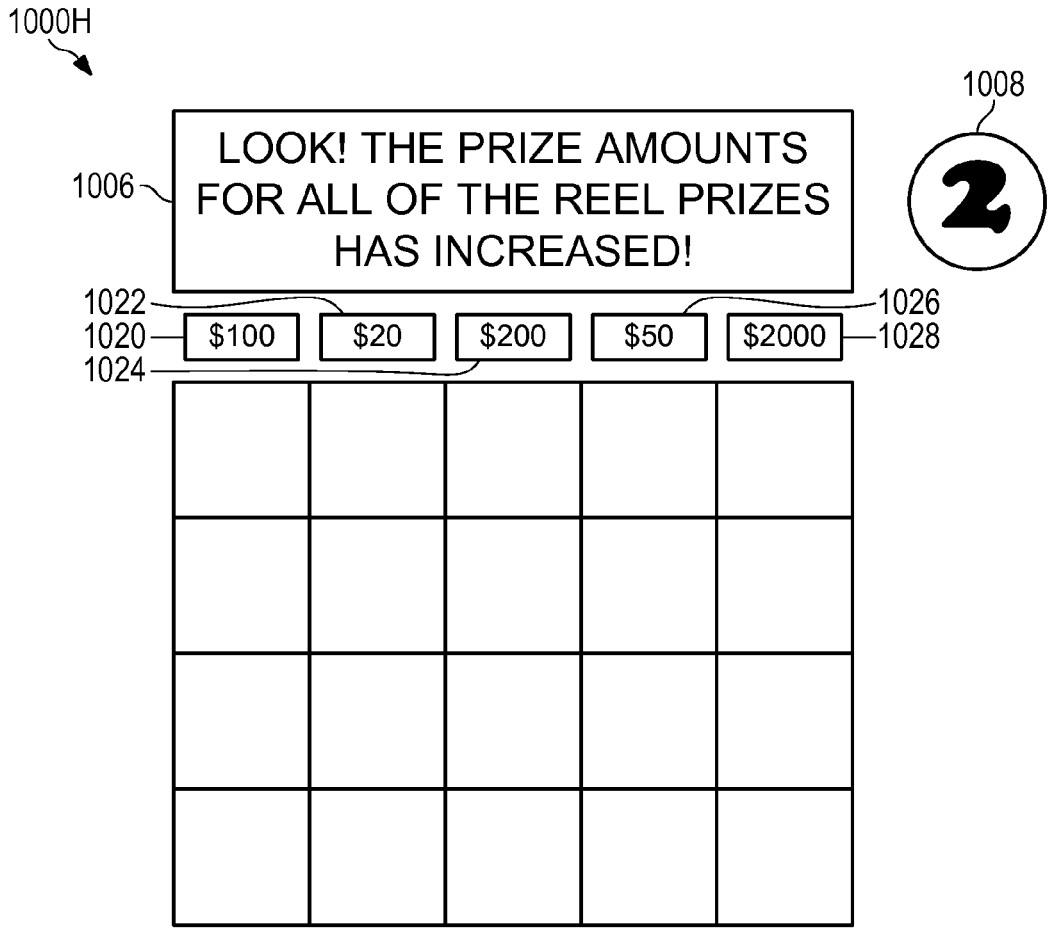
FIG. 10H is another diagram illustrating reel-of-one functionality on a plurality of symbol areas, according to one embodiment.

In FIG. 10H, another diagram illustrating reel-of-one functionality on a plurality of symbol areas 1000H, according to one embodiment. Image 1000H may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may be increased from $50 to $100. In another example, second reel jackpot 1022 may be increased from $10 to $20. In another example, third reel jackpot 1024 may be increased from $100 to $200. Further, fourth reel jackpot 1026 may be increased from $25 to $50. In addition, fifth reel jackpot 1028 may be increased from $1,000 to $2,000. In these examples, first reel jackpot 1020 was increased by 100% and/or an absolute dollar amount of $50. Further, second reel jackpot 1022 was increased by 100% and/or an absolute dollar amount of $10. In addition, third reel jackpot 1024 was increased by 100% and/or an absolute dollar amount of $100. Further, fourth reel jackpot 1026 was increased by 100% and/or an absolute dollar amount of $25. Lastly, fifth reel jackpot 1028 was increased by 100% and/or an absolute dollar amount of $1,000. Message area 1006 may state "LOOK! THE PRIZES AMOUNTS FOR ALL OF THE REEL PRIZES HAS INCREASED!"

Figure 10J:
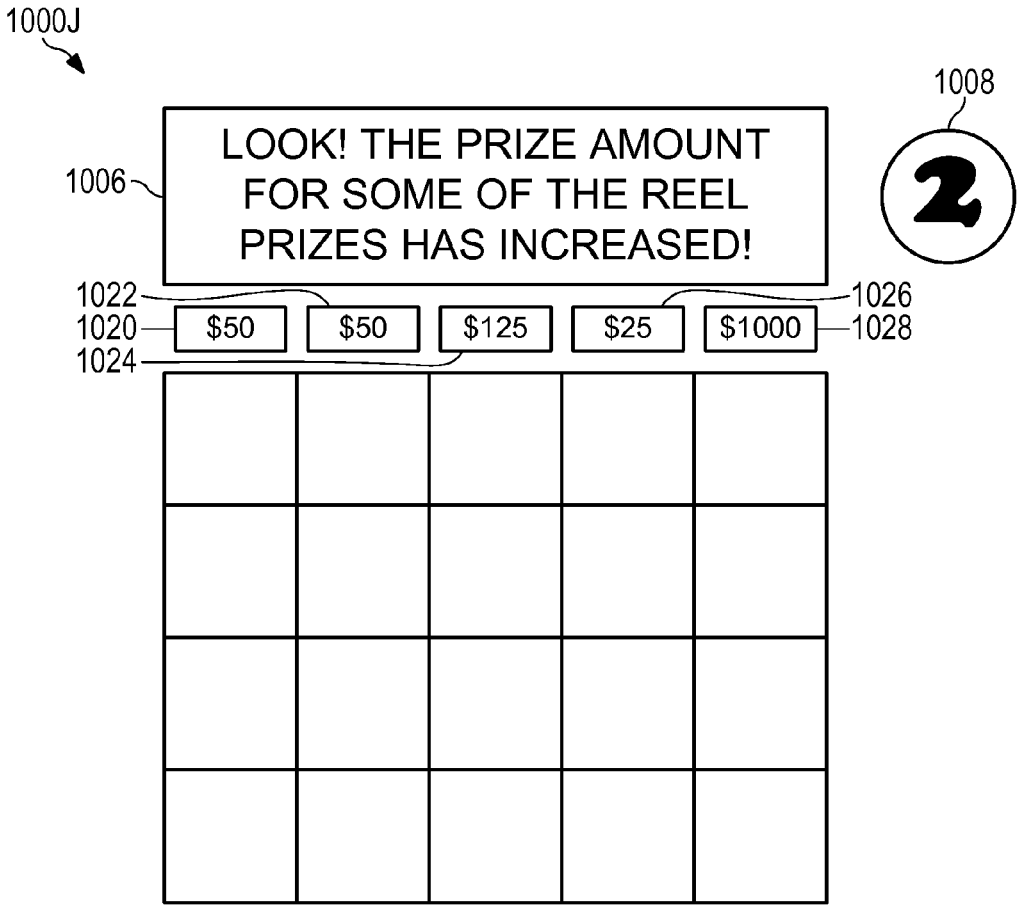
FIG. 10J is another diagram illustrating reel-of-one functionality on a plurality of symbol areas, according to one embodiment.

In FIG. 10J, another diagram illustrating reel-of-one functionality on a plurality of symbol areas 1000J, according to one embodiment. Image 1000J may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may stay constant at $50. In another example, second reel jackpot 1022 may be increased from $10 to $50. In another example, third reel jackpot 1024 may be increased from $100 to $125. Further, fourth reel jackpot 1026 may stay constant at $25. In addition, fifth reel jackpot 1028 may stay constant at $1,000. In these examples, first reel jackpot 1020 was increased by 0% and/or an absolute dollar amount of $0. Further, second reel jackpot 1022 was increased by 500% and/or an absolute dollar amount of $40. In addition, third reel jackpot 1024 was increased by 25% and/or an absolute dollar amount of $25. Further, fourth reel jackpot 1026 was increased by 0% and/or an absolute dollar amount of $0. Lastly, fifth reel jackpot 1028 was increased by 0% and/or an absolute dollar amount of $0. Message area 1006 may state "LOOK! THE PRIZES AMOUNTS FOR SOME OF THE REEL PRIZES HAS INCREASED!"

Figure 10K:
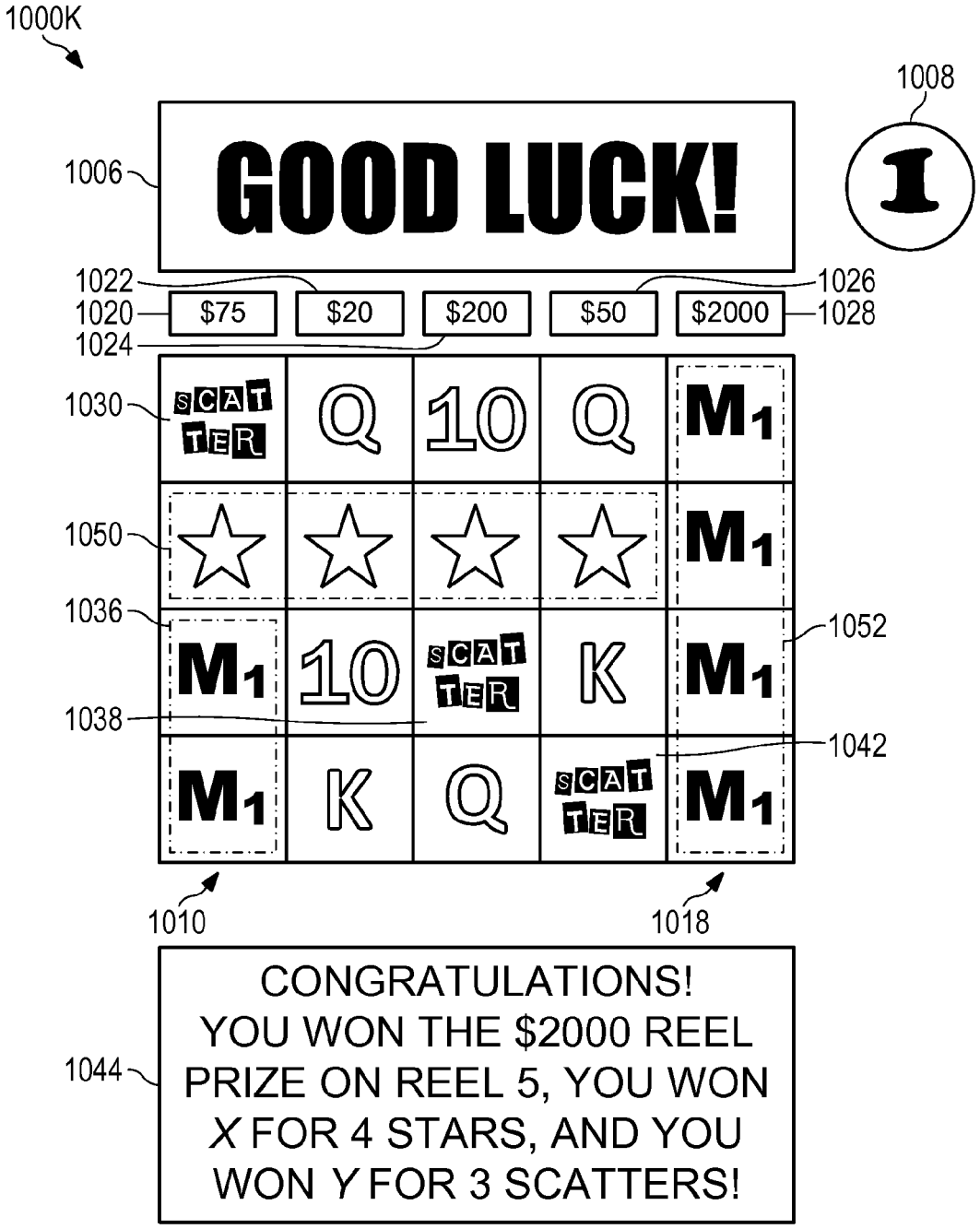
FIG. 10K is another diagram illustrating reel-of-one functionality on a plurality of symbol areas, according to one embodiment.

In FIG. 10K, another diagram illustrating reel-of-one functionality on a plurality of symbol areas 1000K is shown, according to one embodiment. Image 1000K may include message area 1006, bonus spin counter 1008, first reel jackpot 1020 (e.g., $75), second reel jackpot 1022 (e.g., $20), third reel jackpot 1024 (e.g., $200), fourth reel jackpot 1026 (e.g., $50), fifth reel jackpot 1028 (e.g., $2000), second message area 1044, scatter winning combination (e.g., first scatter 1030, second scatter 1038, and third scatter 1042), a second star winning combination 1050, first symbol grouping 1036, and a fifth symbol grouping 1052.

In this example, bonus spin counter 1008 has been reduced by 1 to 1 spin to indicate that the player has utilized one of the player's free spins (e.g., from 2 spins to 1 spin). Second message area 1044 may state "CONGRATULATIONS! YOU WON THE $2000 REEL PRIZE ON REEL 5, YOU WON X FOR 4 STARS AND YOU WON Y FOR 3 SCATTERS!" Further, message area 1006 may state "GOOD LUCK!" In one example, scatter winning combination (e.g., first scatter 1030, second scatter 1038, and third scatter 1042) may generate a scatter payout. In another example, second star winning combination 1050 (e.g., four star symbols) may generate a non-reel-of-one symbol payout. In another example, first symbol grouping 1036 may not be a reel-of-one symbol payout because it does not fill up an entire reel, an entire column, and/or more than two reel-of-one symbols are required to generate a reel-of-one payout. Further, fifth symbol grouping 1052 may generate a reel-of-one symbol payout because first symbol grouping 1052 fills up an entire reel, an entire column, and/or four reel-of-one symbols are required to generate a reel-of-one symbol payouts.

Figure 10L:
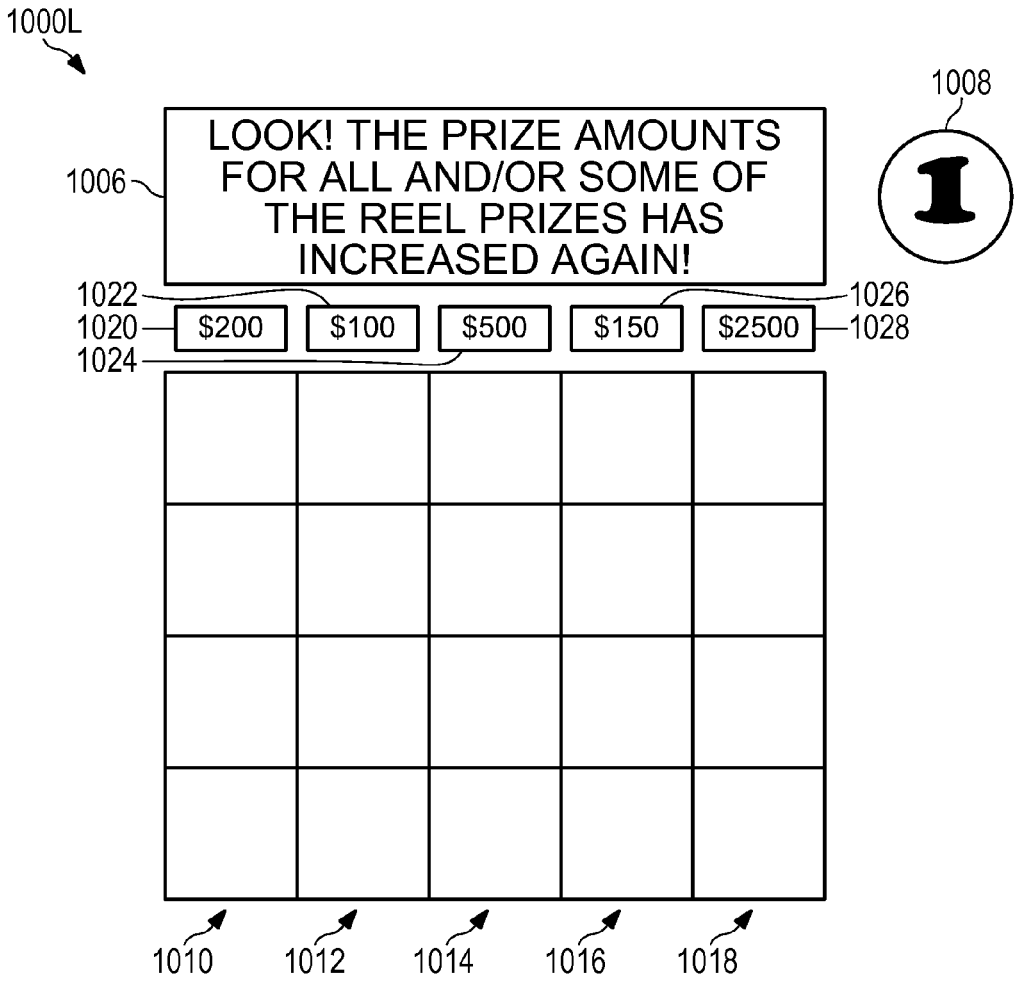
FIG. 10L is another diagram illustrating reel-of-one functionality on a plurality of symbol areas, according to one embodiment.

In FIG. 10L, another diagram illustrating reel-of-one functionality on a plurality of symbol areas 1000L, according to one embodiment. Image 1000L may include message area 1006, bonus spin counter 1008, first reel jackpot 1020, second reel jackpot 1022, third reel jackpot 1024, fourth reel jackpot 1026, and fifth reel jackpot 1028. In this example, after one or more bonus spins has been completed, one or more reel prizes (e.g., first reel jackpot 1020, second reel jackpot 1022, third reel jackpot 1024, fourth reel jackpot 1026, and fifth reel jackpot 1028) may be increased, decreased, and/or remain the same. For example, first reel jackpot 1020 may be increased from $75 to $200. In another example, second reel jackpot 1022 may be increased from $20 to $100. In another example, third reel jackpot 1024 may be increased from $200 to $500. Further, fourth reel jackpot 1026 may be increased from $50 to $150. In addition, fifth reel jackpot 1028 may be increased from $2,000 to $2,500. In these examples, first reel jackpot 1020 was increased by 267% and/or an absolute dollar amount of $125. Further, second reel jackpot 1022 was increased by 500% and/or an absolute dollar amount of $80. In addition, third reel jackpot 1024 was increased by 250% and/or an absolute dollar amount of $300. Further, fourth reel jackpot 1026 was increased by 300% and/or an absolute dollar amount of $100. Lastly, fifth reel jackpot 1028 was increased by 25% and/or an absolute dollar amount of $500. Message area 1006 may state "LOOK! THE PRIZES AMOUNTS FOR ALL AND/OR OF THE REEL PRIZES HAS INCREASED AGAIN!"

Figure 10M:
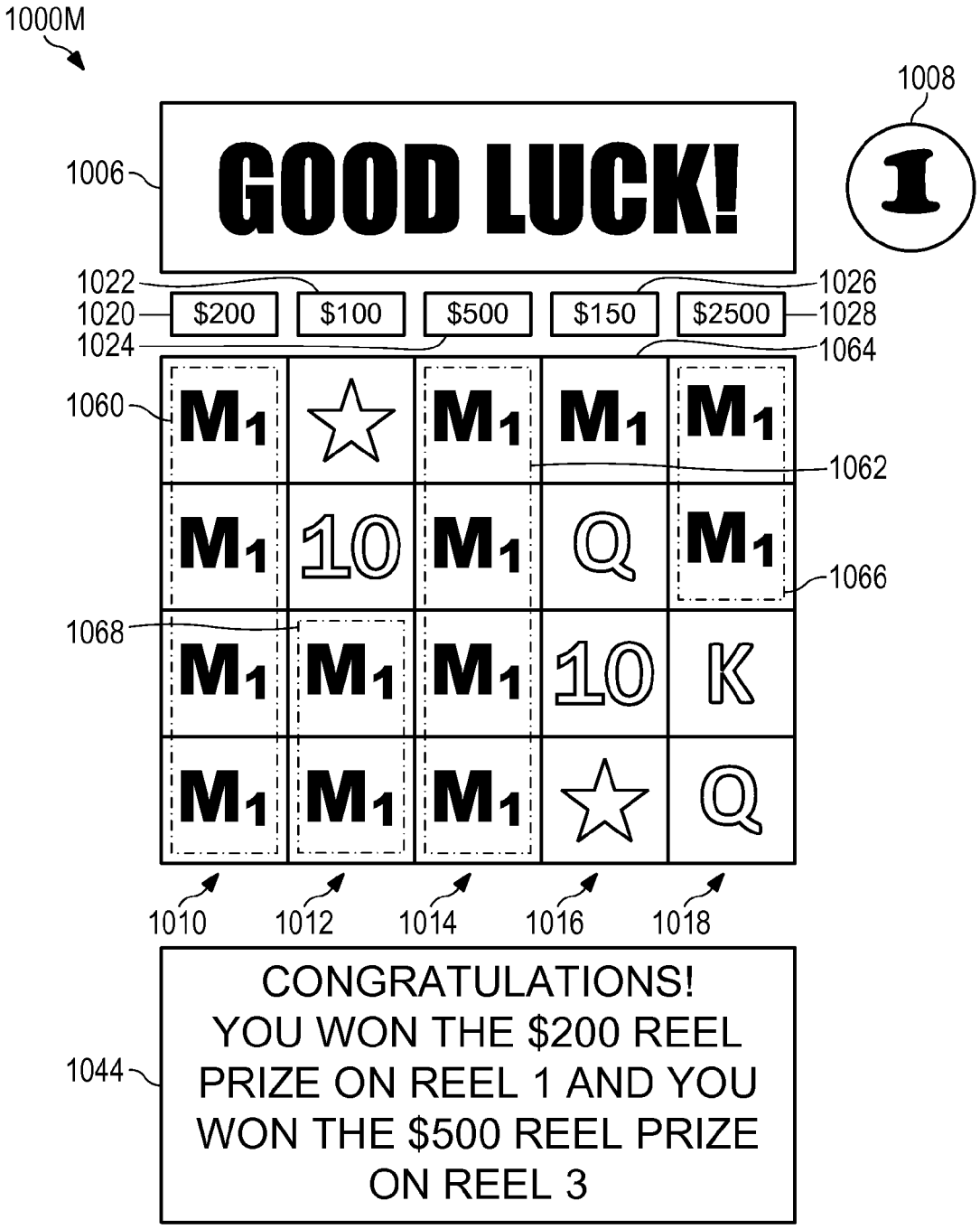
FIG. 10M is another diagram illustrating reel-of-one functionality on a plurality of symbol areas, according to one embodiment.

In FIG. 10M, another diagram illustrating reel-of-one functionality on a plurality of symbol areas 1000M is shown, according to one embodiment. Image 1000M may include message area 1006, bonus spin counter 1008, first reel jackpot 1020 (e.g., $200), second reel jackpot 1022 (e.g., $100), third reel jackpot 1024 (e.g., $500), fourth reel jackpot 1026 (e.g., $150), fifth reel jackpot 1028 (e.g., $2500), second message area 1044, a first symbol grouping winning combination 1060, a second symbol grouping winning combination 1062, a second symbol grouping 1068, a fourth symbol grouping 1064, and a fifth symbol grouping 1066.

In this example, bonus spin counter 1008 has been reduced by 1 to 0 spin to indicate that the player has utilized one of the player's free spins (e.g., from 1 spin to 0 spin). Second message area 1044 may state "CONGRATULATIONS! YOU WON THE $200 REEL PRIZE ON REEL 1 AND YOU WON THE $500 REEL PRIZE ON REEL 3!" Further, message area 1006 may state "GOOD LUCK!" In one example, first symbol grouping winning combination 1060 may generate a reel-of-one symbol payout because the first reel is entirely filled by reel-of-one symbols (e.g., M1). In another example, second symbol grouping winning combination 1062 may generate a reel-of-one symbol payout because the third reel is entirely filled by reel-of-one symbols (e.g., M1). In addition, second symbol grouping 1068 may not be a reel-of-one symbol payout because the reel-of-one symbols do not fill up the entire reel, entire row, and/or more than two reel-of-one symbols are required for a winning combination. Further, fourth symbol grouping 1064 may not be a reel-of-one symbol payout because the reel-of-one symbols do not fill up the entire reel, entire row, and/or more than one reel-of-one symbol is required for a winning combination. In addition, fifth symbol grouping 1066 may not be a reel-of-one symbol payout because the reel-of-one symbols do not fill up the entire reel, entire row, and/or more than two reel-of-one symbols are required for a winning combination.

Figure 11:
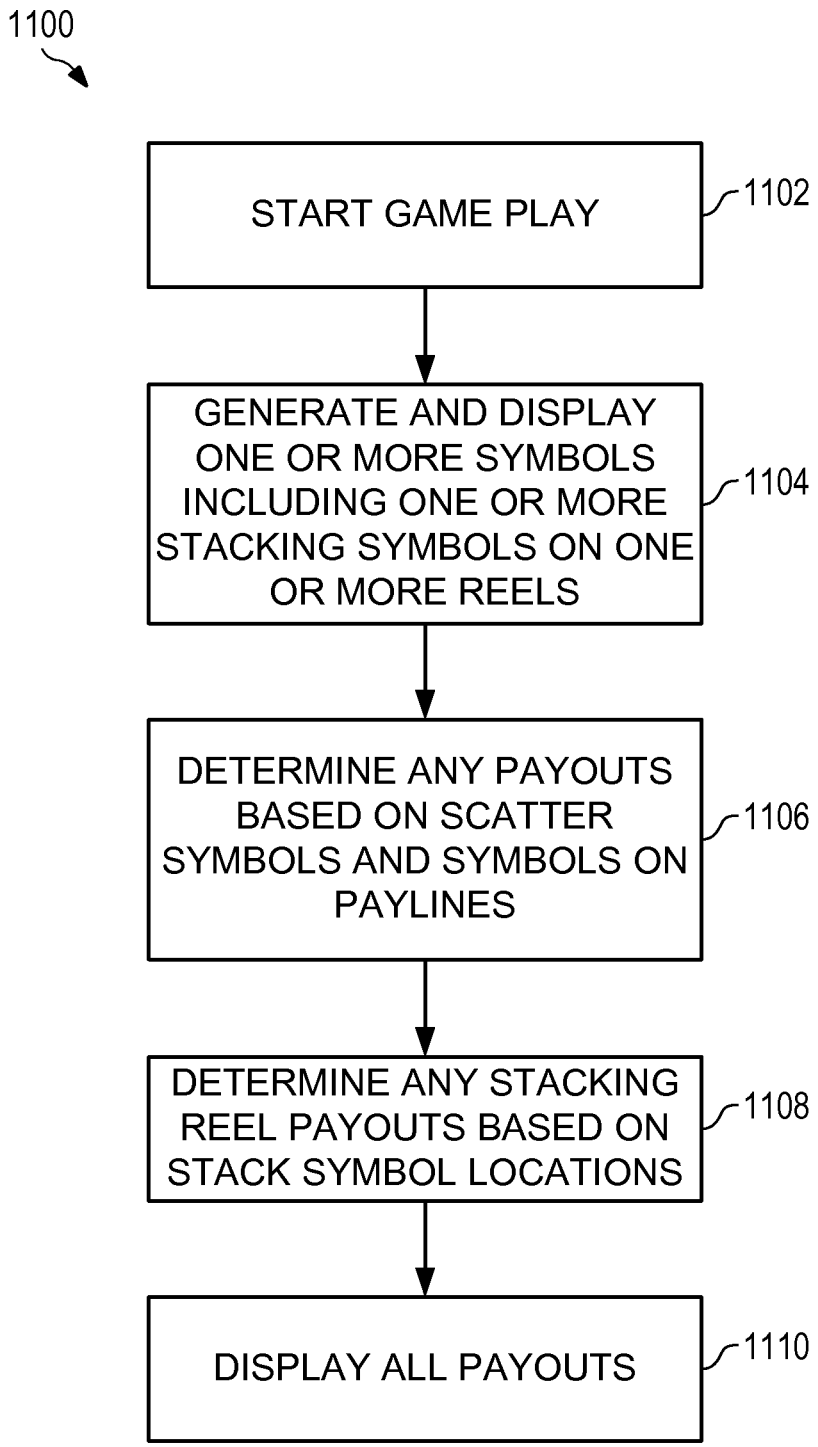
FIG. 11 is a flow diagram for reel-of-one functionality game play, according to one embodiment.

In FIG. 11, a flow diagram for reel-of-one functionality game play 1100 is shown, according to one embodiment. The method may include starting game play (step 1102). The method may include generating and displaying one or more symbols including one or more stacking symbols (and/or reel-of-one game play) on one or more reels (step 1104). In one example, stacking symbols may be two or more contiguous symbols placed on a reel strip where the two or more contiguous symbols are similar, identical, and/or create a composite of an image. In one example, a composite image may be where the two or more contiguous symbols create a larger image. For example, three symbols that create a women's image, a car image, a battleship image, etc. The method may include determining any payouts based on scatter symbols and/or symbols on one or more paylines (step 1106). The method may include determining any stacking symbol reel payouts based on one or more stacking symbol locations (step 1108). The method may include displaying one or more determined payouts (step 1110) (see FIG. 10C).

Figure 12:
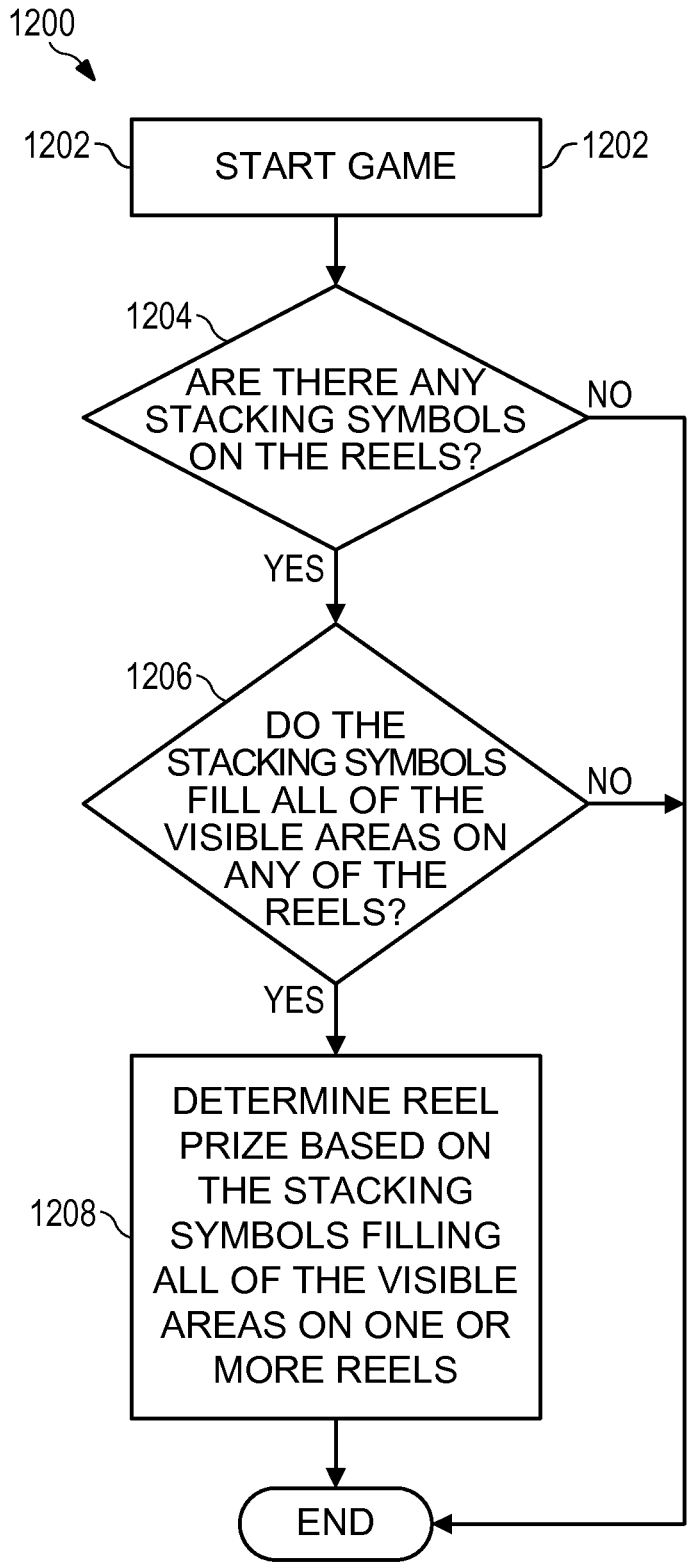
FIG. 12 is another flow diagram for reel-of-one functionality game play, according to one embodiment.

In FIG. 12, another flow diagram for reel-of-one functionality game play 1200 is shown, according to one embodiment. The method may include starting game play (step 1202). The method may include one or more processors (e.g., electronic gaming device 100, electronic gaming system 200, etc.) determining whether there are any stacking symbols on the reels (step 1204). If there are no stacking symbols on the reels, then the method may end. If there are stacking symbols on the reels, then the method may include one or more processors (e.g., electronic gaming device 100, electronic gaming system 200, etc.) determining whether the stacking symbols fill all of the visible areas on any of the reels (step 1206). If the stacking symbols do not fill all of the visible areas on any of the reels, then the method may end. If the stacking symbols do fill all of the visible areas on any of the reels, then the method may include determining one or more reel prizes based on the stacking symbols filling all of the visible areas on one or more reels (step 1208). The method may display one or more payouts and/or prizes and then the method may end.

Figure 13:
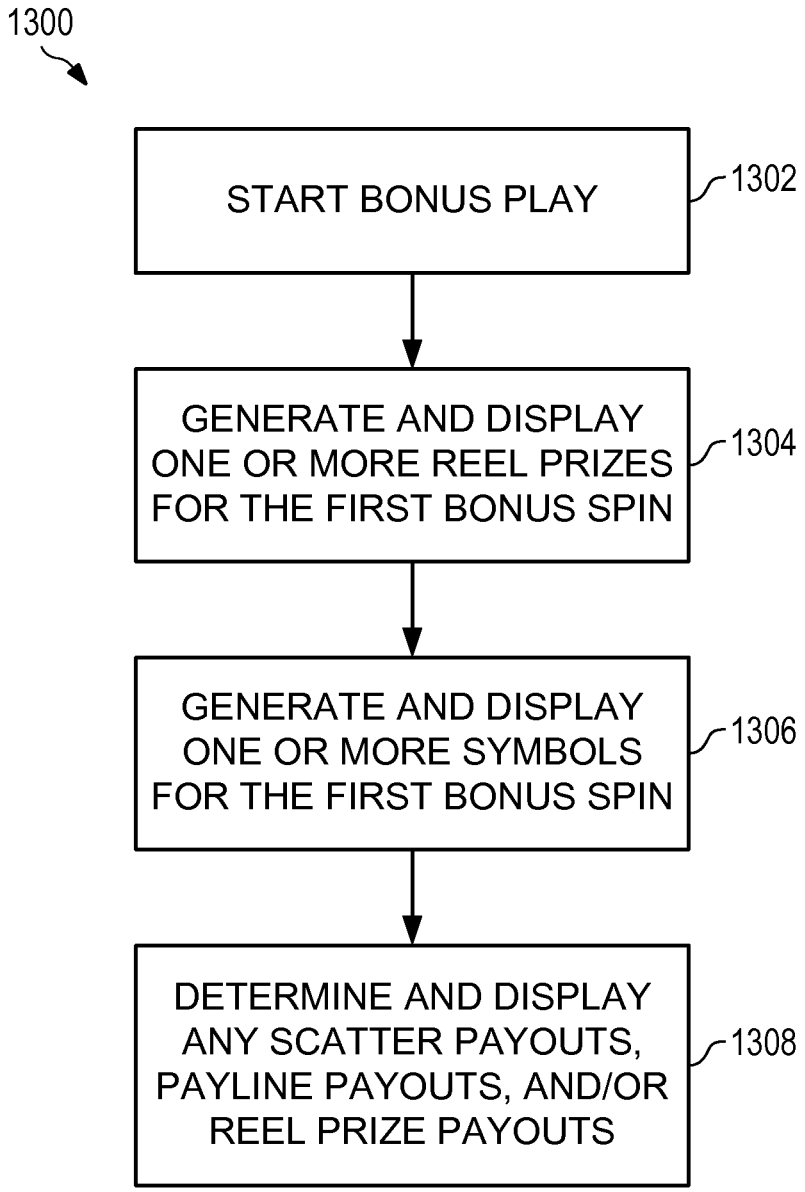
FIG. 13 is a flow diagram for reel-of-one functionality game play, according to one embodiment.

In FIG. 13, a flow diagram for reel-of-one functionality game play 1300 is shown, according to one embodiment. The method may include starting one or more bonus game plays (step 1302). The method may include generating and displaying one or more reel prizes for the first bonus spin (step 1304). The method may include generating and displaying one or more symbols for the first bonus spin (step 1306). The method may include determining and displaying any scatter payouts, payline payouts, and/or reel prize payouts (step 1308) (see FIG. 10C).

Figure 14:
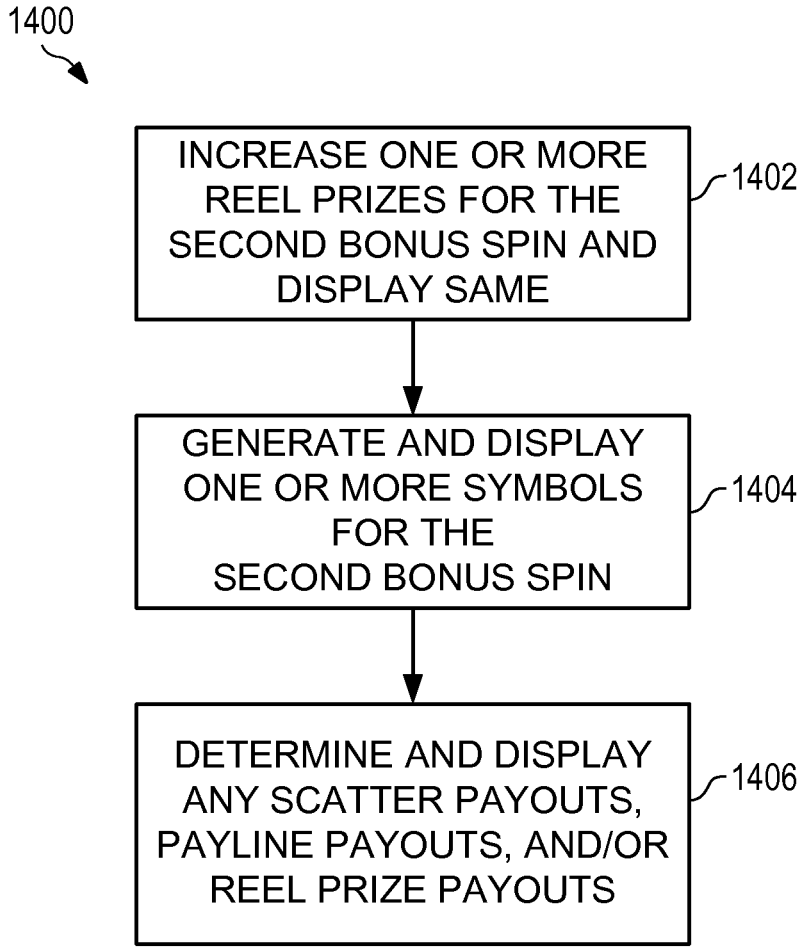
FIG. 14 is a flow diagram for reel-of-one functionality game play, according to one embodiment.

In FIG. 14, a flow diagram for reel-of-one functionality game play 1400 is shown, according to one embodiment. The method may include increasing one or more reel prizes for the second bonus spin (e.g., any additional bonus spins and/or subsequent bonus spins) and display the same (step 1402). The method may include generating and displaying one or more symbols for the second bonus spin (step 1404). The method may include determining and displaying any scatter payouts, payline payouts, and/or reel prize payouts (step 1406) (see FIGS. 10A-10M).

Figure 15:
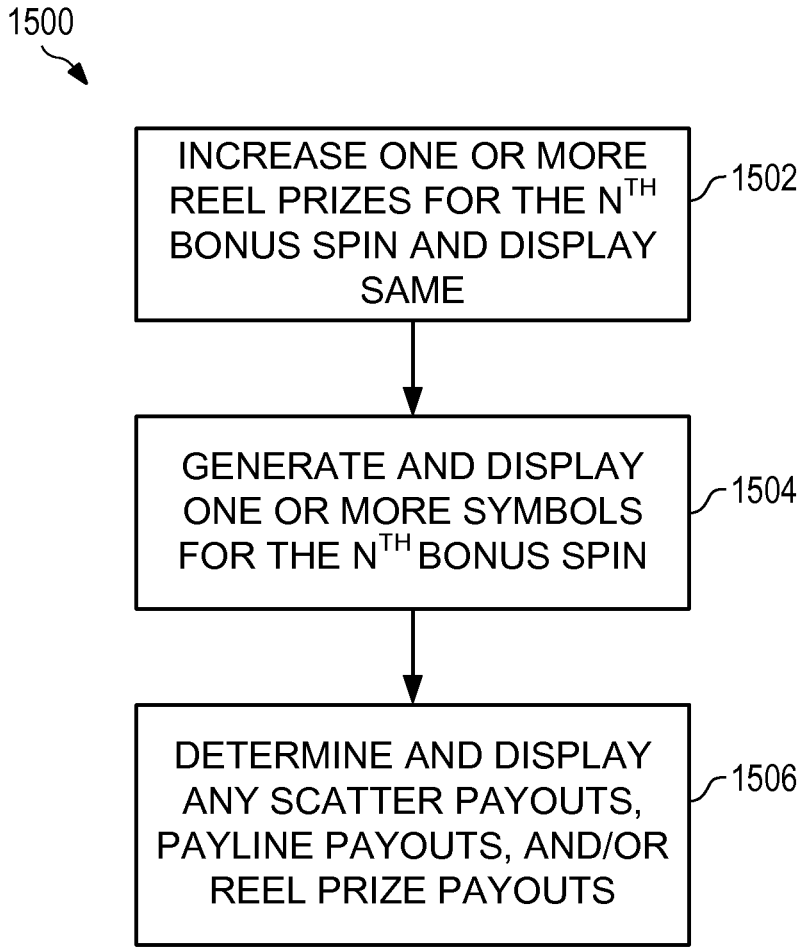
FIG. 15 is a flow diagram for reel-of-one functionality game play, according to one embodiment.

In FIG. 15, a flow diagram for reel-of-one functionality game play 1500 is shown, according to one embodiment. The method may include increasing one or more reel prizes for the Nth bonus spin and displaying the same (step 1502). The method may include generating and displaying one or more symbols for Nth bonus spin (step 1504). The method may include determining and displaying any scatter payouts, payline payouts, and/or reel prize payouts (step 1506) (see FIGS. 10A-10M).

In one embodiment, the electronic gaming device may include a plurality of reels. The plurality of reels may include one or more areas. The electronic gaming device includes one or more memory devices and one or more processors. The memory may include one or more reel-of-one functionality modules. The processor may generate one or more symbols to be located in the one or more areas. The processor may generate one or more reel-of-one symbol groups. The processor may place a first reel-of-one symbol group on a first reel, a second reel-of-one symbol group on a second reel, and/or an Nth reel-of-one symbol group on a Nth reel.

In another example, the processor may generate one or more payouts based on one or more locations of the one or more symbols. Further, the processor may generate one or more reel-of-one payouts based on one or more locations of at least a portion of one or more reel-of-one groups. In addition, the processor may generate one or more reel-of-one payouts based on one or more locations of at least a portion of one or more reel-of-one groups. In another example, the one or more reel-of-one payouts may be based on one or more reel-of-one groups filling all areas on a reel. In addition, the filling all areas on the reel may include having a reel-of-one symbol in all visible areas on the reel. In another example, the processor may generate one or more reel jackpots. Further, the one or more jackpots may include a first reel jackpot, a second reel jackpot, and/or an Nth jackpot. In another example, the first reel jackpot may relate to the first reel, the second reel jackpot may relate to the second reel, and/or the Nth reel jackpot may relate to the Nth reel. In another example, the first reel jackpot, the second reel jackpot, and/or the Nth reel jackpot are modified based on a completion of one or more bonus spins.

In another embodiment, the method of providing game play via an electronic gaming device may include: generating one or more symbols to be located in one or more areas; generating one or more reel-of-one symbol grouping to be located on one or more reels; and/or placing a first reel-of-one symbol group on a first reel and a second reel-of-one symbol group on a second reel.

In another example, the method may include: generating one or more payouts based on one or more locations of the one or more symbols; generating one or more reel-of-one symbol payouts based on one or more locations of the one or more reel-of-one groupings; and/or generating one or more reel jackpots.

In another example, the one or more reel-of-one payouts are based on one or more reel-of-one groups filling all areas on a reel. Further, the filling all areas on the reel includes having a reel-of-one symbol in all visible areas on the reel.

In another embodiment, the electronic gaming system may include a server (including a server processor, a server memory, etc.) and a display device including a plurality of reels. The plurality of reels includes one or more areas. The server memory may include one or more reel-of-one functionality modules. The server processor may generate one or more symbols to be located in the one or more areas, generate one or more reel-of-one symbol groups, and/or place a first reel-of-one symbol group on a first reel, a second reel-of-one symbol group on a second reel, and/or an Nth reel-of-one symbol group on an Nth reel.

In another example, the server processor may generate one or more payouts based on one or more locations of the one or more symbols. Further, the server processor may generate one or more reel-of-one payouts based on one or more locations of at least a portion of one or more reel-of-one groups. In addition, the server processor may generate one or more reel jackpots.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system may be powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system may be different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

The invention claimed is:

1. An electronic gaming device comprising:

a credit device configured to accept an item associated with a monetary value;

a user input device configured to enable a player to select a wager amount and initiate a game play where the wager amount is subtracted from a credit balance, the credit balance being funded at least in part via the credit device;

a plurality of reels, the plurality of reels including one or more areas, the plurality of reels including a first reel with displayed areas and non-displayed areas;

a memory, the memory including a reel-of-one functionality module;

a processor configured to generate one or more symbols to be located in the one or more areas, the processor configured to generate one or more reel-of-one symbol groups comprising a plurality of the same symbol in adjacent areas, the processor configured to place a first reel-of-one symbol group on the first reel, the processor configured to cause a portion of the symbols associated with the first reel to be displayed in the displayed areas and to generate a reel-of-one symbol payout when the reel-of-one symbols fill all of the displayed areas of the first reel, but not award a reel-of-one payout if the reel-of-one symbols are displayed in one or more, but not all, of the displayed areas of the first reel;

wherein any determined payout is added to the credit balance.

2. The electronic gaming device of claim 1, wherein the processor is further configured to generate one or more payouts based on one or more locations of the one or more symbols which do not comprise reel-of-one symbols.

3. The electronic gaming device of claim 2, wherein the processor is further configured to generate a plurality of one or more reel-of-one symbol groups comprising a plurality of the same symbol in adjacent areas and associate at least one reel-of-one symbol group with at least a first reel and a second reel of the plurality of reels and generate a reel-of-one payout corresponding to each reel which displays a reel-of-one symbol in each displayed area of the reel.

4. The electronic gaming device of claim 1, wherein the reel-of-one symbol groups comprise a stack of three or more of the same symbol in adjacent positions of the first reel.

5. The electronic gaming device of claim 1, wherein the reel-of-one payout comprises a reel jackpot.

6. The electronic gaming device of claim 5, wherein a different jackpot is associated with each of the plurality of reels.

7. The electronic gaming device of claim 6, wherein a first of the jackpots relates to the first reel.

8. The electronic gaming device of claim 6, wherein the first reel jackpot is modified based on a completion of a bonus spin.

9. A method of providing game play via an electronic gaming device comprising:

receiving via a credit device an item associated with a monetary value;

establishing via one or more processors a credit balance based at least in part on the received item;

receiving via a wager button a wager amount on a play of a game, wherein the wager amount is deducted from the credit balance;

generating one or more symbols to be located in one or more positions of one or more reels;

generating one or more reel-of-one symbol groupings to be located on the one or more reels, each of the one or more reel-of-one symbol groupings comprising a plurality of the same symbol in adjacent positions;

placing a first reel-of-one symbol group on at least a first reel of the one or more reels;

displaying a plurality of positions of each of the one or more reels in a display area; and generating a reel-of-one symbol payout when the reel-of-one symbols fill all of the positions in the display area corresponding to any one of the one or more reels and not awarding a reel-of-one payout if the reel-of-one symbols are displayed in some, but not all of the positions in the display area corresponding to any one of the one or more reels;

wherein any determined payout is added to the credit balance.

10. The method of claim 9, further comprising generating one or more payouts based on one or more locations of the one or more symbols which do not comprise reel-of-one symbols.

11. The method of claim 9, wherein the reel-of-one symbols groups comprise a stack of three or more of the same symbol in adjacent positions of at least the first reel.

12. The method of claim 9, wherein the reel-of-one payout comprises a reel jackpot.

13. An electronic gaming system comprising:

a credit device configured to accept an item associated with a monetary value;

a user input device configured to enable a player to select a wager amount and initiate a game play, wherein the wager amount is subtracted from a credit balance funded at least in part via the credit device;

a server including a server processor and a server memory;

a display device including a plurality of reels, the plurality of reels including one or more areas, the plurality of reels including a first reel with displayed areas and non-displayed areas;

the server memory including one or more reel-of-one functionality modules;

the server processor configured to generate one or more symbols to be located in the one or more areas, the server processor configured to generate one or more reel-of-one symbol groups comprising a plurality of the same symbol in adjacent areas, the server processor configured to place a first reel-of-one symbol group on a first reel, the server processor configured to cause a portion of the symbols associated with the first reel to be displayed in the displayed areas and to generate a reel-of-one symbol payout when the reel-of-one symbols fill all of the displayed areas of the first reel, but not award a reel-of-one payout if the reel-of-one symbols are displayed in one or more, but not all, of the displayed areas of the first reel;

wherein any determined payout is added to the credit balance.

14. The electronic gaming system of claim 13, wherein the server processor is further configured to generate one or more payouts based on one or more locations of the one or more symbols which do not comprise reel-of-one symbols.

15. The electronic gaming system of claim 13, wherein the reel-of-one payout comprises a reel jackpot.

16. The electronic gaming device of claim 1, wherein the processor is further configured to generate a second reel-of-one symbol group on a second reel.

17. The electronic gaming device of claim 1, wherein the plurality of reels are digital reels.

18. The electronic gaming device of claim 1, wherein the displayed areas of the first reel are visible to the player and the non-displayed areas of the first reel are invisible to the player.

* * * * *